US011270645B2

(12) United States Patent
Park et al.

(10) Patent No.: US 11,270,645 B2
(45) Date of Patent: Mar. 8, 2022

(54) ORGANIC LIGHT EMITTING DISPLAY DEVICE FOR DETECTING HEAT OF AN ANALOGUE-TO-DIGITAL CONVERTING PORTION

(71) Applicant: LG Display Co., Ltd., Seoul (KR)

(72) Inventors: Mangyu Park, Paju-si (KR); Zonggun Oh, Incheon (KR); Miso Kim, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/119,062

(22) Filed: Dec. 11, 2020

(65) Prior Publication Data

US 2021/0201796 A1 Jul. 1, 2021

(30) Foreign Application Priority Data

Dec. 26, 2019 (KR) ..... 10-2019-0175200

(51) Int. Cl.
*G09G 3/3258* (2016.01)
*G09G 3/3291* (2016.01)

(52) U.S. Cl.
CPC ..... *G09G 3/3258* (2013.01); *G09G 3/3291* (2013.01); *G09G 2310/027* (2013.01); *G09G 2310/0297* (2013.01)

(58) Field of Classification Search
CPC ..... G09G 3/3258
USPC ..... 345/204
See application file for complete search history.

(56) References Cited

U.S. PATENT DOCUMENTS

2018/0174517 A1* 6/2018 Lee ..... G09G 3/3291
2019/0027095 A1* 1/2019 Kim ..... H01L 51/5203
2020/0126482 A1* 4/2020 Yang ..... G09G 3/3241

FOREIGN PATENT DOCUMENTS

KR 10-2013-0066449 A 6/2013
KR 10-2015-0064460 A 6/2015
KR 10-2015-0065026 A 6/2015
KR 10-2016-0007833 A 1/2016

* cited by examiner

*Primary Examiner* — Long D Pham
(74) *Attorney, Agent, or Firm* — Birch, Stewart, Kolasch & Birch, LLP

(57) ABSTRACT

The present disclosure provides an organic light emitting display device capable of sensing changes in characteristics due to a heat of an analogue-to-digital converting portion to convert sensing voltages corresponding to the threshold values into digital values with the threshold voltages when the threshold voltages of the driving transistors of an organic light emitting display panel are sensed in each horizontal line unit.

17 Claims, 19 Drawing Sheets

| CLASSIFICATION | Line | 1ch | 2ch | 3ch | 4ch | 5ch | 6ch | 7ch | 8ch | 9ch | 10ch | 11ch | 12ch | 13ch | 14ch | 15ch | 16ch | min | max | avg | FLUCTUATIONS |
|---|---|---|---|---|---|---|---|---|---|---|---|---|---|---|---|---|---|---|---|---|---|
| SIMULTANEOUS METHOD | 1H | −0.318 | −0.318 | −0.318 | −0.318 | −0.318 | −0.318 | −0.318 | −0.318 | −0.318 | −0.318 | −0.318 | −0.318 | −0.318 | −0.318 | −0.318 | −0.318 | −0.318 | −0.318 | −0.318 | 2.954 |
| | 2H | 1.702 | 1.702 | 1.702 | 1.702 | 1.702 | 1.702 | 1.702 | 1.702 | 1.702 | 1.702 | 1.702 | 1.702 | 1.702 | 1.702 | 1.702 | 1.702 | 1.702 | 1.702 | 1.702 | |
| | 3H | 0.312 | 0.312 | 0.312 | 0.312 | 0.312 | 0.312 | 0.312 | 0.312 | 0.312 | 0.312 | 0.312 | 0.312 | 0.312 | 0.312 | 0.312 | 0.312 | 0.312 | 0.312 | 0.312 | |
| | 4H | 1.127 | 1.127 | 1.127 | 1.127 | 1.127 | 1.127 | 1.127 | 1.127 | 1.127 | 1.127 | 1.127 | 1.127 | 1.127 | 1.127 | 1.127 | 1.127 | 1.127 | 1.127 | 1.127 | |
| | 5H | 2.273 | 2.273 | 2.273 | 2.273 | 2.273 | 2.273 | 2.273 | 2.273 | 2.273 | 2.273 | 2.273 | 2.273 | 2.273 | 2.273 | 2.273 | 2.273 | 2.273 | 2.273 | 2.273 | |
| | 6H | 0.000 | 0.000 | 0.000 | 0.000 | 0.000 | 0.000 | 0.000 | 0.000 | 0.000 | 0.000 | 0.000 | 0.000 | 0.000 | 0.000 | 0.000 | 0.000 | 0.000 | 0.000 | 0.000 | |
| | 7H | 0.641 | 0.641 | 0.641 | 0.641 | 0.641 | 0.641 | 0.641 | 0.641 | 0.641 | 0.641 | 0.641 | 0.641 | 0.641 | 0.641 | 0.641 | 0.641 | 0.641 | 0.641 | 0.641 | |
| | 8H | −0.681 | −0.681 | −0.681 | −0.681 | −0.681 | −0.681 | −0.681 | −0.681 | −0.681 | −0.681 | −0.681 | −0.681 | −0.681 | −0.681 | −0.681 | −0.681 | −0.681 | −0.681 | −0.681 | |
| | 9H | 0.392 | 0.392 | 0.392 | 0.392 | 0.392 | 0.392 | 0.392 | 0.392 | 0.392 | 0.392 | 0.392 | 0.392 | 0.392 | 0.392 | 0.392 | 0.392 | 0.392 | 0.392 | 0.392 | |
| | 10H | −0.477 | −0.477 | −0.477 | −0.477 | −0.477 | −0.477 | −0.477 | −0.477 | −0.477 | −0.477 | −0.477 | −0.477 | −0.477 | −0.477 | −0.477 | −0.477 | −0.477 | −0.477 | −0.477 | |
| DISCRETE METHOD | 1H | −0.318 | −0.821 | −0.603 | −0.985 | 0.425 | 0.205 | −0.354 | −1.333 | 0.281 | −0.330 | 0.988 | 1.049 | 0.567 | 0.382 | 0.470 | 1.616 | −1.333 | 1.616 | 0.077 | 0.880 |
| | 2H | 1.702 | −0.892 | 0.680 | 0.259 | −0.166 | −0.836 | −0.496 | 0.354 | −0.489 | 0.578 | 0.524 | 1.626 | −0.635 | 0.317 | 0.467 | −1.211 | −1.211 | 1.702 | 0.111 | |
| | 3H | 0.312 | −1.747 | 0.314 | −0.376 | −0.056 | 1.438 | 0.728 | 0.812 | −0.136 | 0.346 | −2.806 | −2.516 | −0.144 | −0.023 | −2.665 | 0.834 | −2.806 | 1.438 | −0.355 | |
| | 4H | 1.127 | −0.215 | −0.864 | −0.797 | −0.035 | −0.312 | −0.441 | 0.006 | 0.147 | −0.553 | −0.403 | −1.091 | −0.267 | −1.536 | 0.406 | 1.725 | −1.536 | 1.725 | −0.194 | |
| | 5H | 2.273 | −1.391 | 1.153 | −1.099 | 1.455 | 0.001 | 0.635 | 1.063 | 0.199 | 0.085 | −1.005 | 0.576 | −1.572 | −0.196 | 0.694 | 0.803 | −1.572 | 2.273 | 0.230 | |
| | 6H | 0.000 | 1.877 | 0.993 | 1.305 | 0.934 | 0.519 | 0.017 | 1.304 | −0.901 | 0.915 | 1.295 | 1.297 | 0.728 | 0.002 | −0.257 | −1.633 | −1.633 | 1.877 | 0.525 | |
| | 7H | 0.641 | 0.479 | 1.159 | 2.126 | −0.574 | −1.349 | 1.381 | −1.399 | 0.922 | −1.059 | −1.458 | 1.071 | −1.331 | −0.845 | −0.262 | 0.862 | −1.458 | 2.126 | 0.023 | |
| | 8H | −0.681 | 0.162 | 0.500 | −0.719 | −0.792 | 0.312 | 0.563 | 0.682 | 0.610 | 1.205 | −0.281 | 0.258 | 0.558 | 0.726 | 1.397 | −0.499 | −0.792 | 1.397 | 0.174 | |
| | 9H | 0.392 | −0.623 | 2.578 | −0.851 | −0.302 | −0.373 | 0.474 | −0.129 | −1.331 | −0.834 | 1.899 | −0.253 | −0.345 | 0.830 | −0.368 | 1.875 | −1.331 | 2.578 | 0.165 | |
| | 10H | −0.477 | 0.153 | −1.303 | 0.458 | 0.285 | 0.744 | −0.519 | 0.155 | 0.985 | −0.847 | 0.406 | −1.470 | −1.367 | 2.236 | −0.348 | −1.589 | −1.589 | 2.236 | −0.156 | |

FIG. 16

ORGANIC LIGHT EMITTING DISPLAY DEVICE FOR DETECTING HEAT OF AN ANALOGUE-TO-DIGITAL CONVERTING PORTION

CROSS-REFERENCE TO RELATED APPLICATION

This application claims priority to and the benefit of Korean Patent Application No. 10-2019-0175200, filed in the Republic of Korea on Dec. 26, 2019, the entire contents of which are incorporated herein by reference into the present application.

BACKGROUND

1. Field of the Invention

The present disclosure relates to an organic light emitting display device, and more particularly, to an organic light emitting display device that senses characteristics of a driving transistor through a sensing line.

2. Description of Related Art

In organic light emitting display devices in related art, deviations in characteristics such as a threshold voltage (Vth) or mobility of a driving transistor of each pixel can occur due to reasons such as process deviation and deterioration. In some examples, a deviation can occur in the amount of current used to drive organic light emitting diodes (OLEDs), and thus, contrast deviations can occur between pixels.

To address the above problems, various types of compensation methods can be used for the organic light emitting display devices to sense the threshold voltage or the mobility of the driving transistor and to compensate for input image data based on the sensed value.

To use the compensation method, the organic light emitting display panel can include sensing lines, and voltage values received through the sensing lines can be converted into digital values by an analogue-to-digital (or analog-to-digital) converting portion and can be transmitted to a controller. The controller can determine the amount of changes in threshold voltage or mobility based on the digital values.

In particular, all threshold voltages of the driving transistors can be sensed in a horizontal line unit provided in the organic light emitting display panel immediately before electronic devices including the organic light emitting display devices are turned off, for example, from a time point at which an image is not output and until the electronic devices are turned off and information on the sensed threshold voltages is stored in a storage portion.

A temperature of the analogue-to-digital converting portion is gradually lowered from the time point at which the image is not output and until the electronic device is turned off.

Accordingly, the temperature of the analogue-to-digital converting portion determined when the threshold voltages of the driving transistors disposed in a first horizontal line of the organic light emitting display panel are sensed can be different from the temperature of the analogue-to-digital converting portion determined when the threshold voltages of the driving transistor disposed in a last horizontal line of the organic light emitting display panel are sensed.

The analogue-to-digital converting portion can include an integrated circuit (IC) and the IC is heat-sensitive.

Therefore, if the threshold voltages of all driving transistors of the organic light emitting display panel are sensed based on the same reference, without considering the temperature changes of the analogue-to-digital converting portion, normal threshold voltages may not be sensed.

SUMMARY OF THE INVENTION

To address the problems and limitations associated with the related art, the present disclosure provides an improved organic light emitting display device that can sense a threshold voltage as well as changes in characteristics due to a heat of an analogue-to-digital converting portion to convert, into a digital value, sensing voltage corresponding to the threshold voltage when the threshold voltage of a driving transistor is sensed in each horizontal line unit of an organic light emitting display panel.

To overcome and address the technical problems and limitations associated with the related art, according to the present disclosure, the organic light emitting display device can include an organic light emitting display panel with a plurality of pixels and circuits, a data driver with at least one data driver integrated circuit (IC) connected to sensing lines for each pixel and configured to supply data voltages to pixel driving circuits through data lines disposed in the organic light emitting display panel, and a controller configured to, in response to receiving a device off signal from an external system, control the data driver IC to generate sensing data corresponding to threshold voltages of the driving transistors and at least two thermal property sensing data corresponding to changes in characteristics due to a heat of an analogue-to-digital converting portion of the data driver IC, in each horizontal line unit of the organic light emitting display panel, with time intervals when a device off signal is received from an external system and to calculate an amount of changes in threshold voltages of the driving transistors in each horizontal line unit based on the sensing data and at least two pieces of thermal property sensing data received through the analogue-to-digital converting portion.

According to the present disclosure, as the threshold voltages can be sensed in consideration of the temperature changes of the analogue-to-digital converting portion, the threshold voltages can be accurately determined to calculate correct external compensation values.

According to the present disclosure, a noise deviation occurring due to temperature fluctuation can also be reduced with time intervals between sensing time points at which temperatures are changed.

BRIEF DESCRIPTION OF THE DRAWINGS

FIGS. 16 and 17 are each an exemplary diagram showing an example magnitude of noise when discrete sampling is performed according to the present disclosure.

DETAILED DESCRIPTION OF THE EMBODIMENTS

Figure 1:
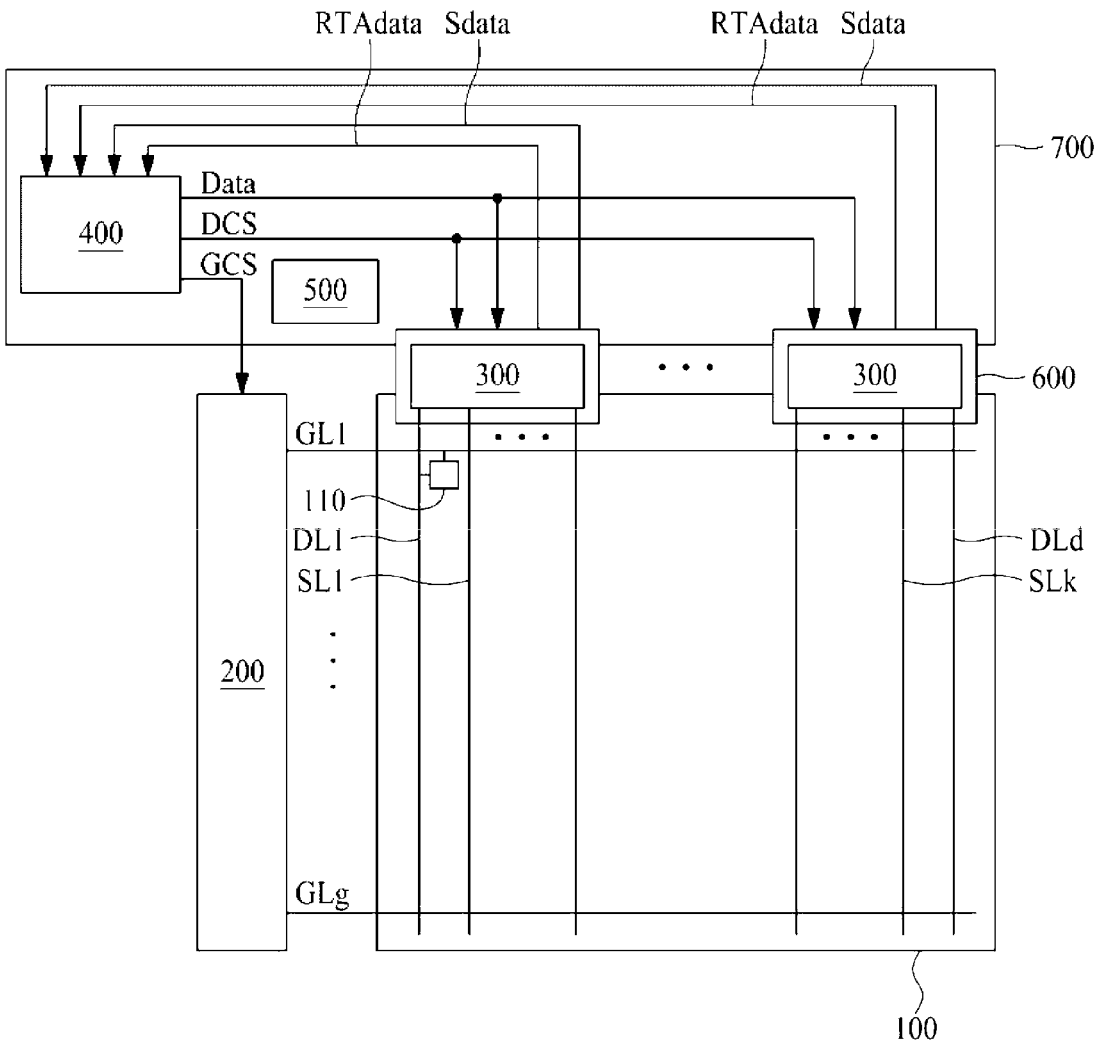
FIG. 1 is an exemplary diagram showing an example organic light emitting display device according to the present disclosure.

Some embodiments of the present disclosure and implementation methods thereof will be clarified through following embodiments described with reference to the accompanying drawings. The present disclosure can, however, be embodied in different manners and should not be construed as limited to example embodiments set forth herein. Rather, these example embodiments are provided so that this disclosure will be thorough and complete, and will fully convey the scope of example embodiments to a person having an ordinary skill in the art to which the present disclosure pertains. Further, the present disclosure is only defined by scopes of claims.

Reference now should be made to the drawings, in which the same reference numerals are used throughout the different drawings to designate the same or similar components.

The shapes, sizes, ratios, angles, numbers, and the like shown in the accompanying drawings for describing embodiments of the present disclosure are merely examples, and the present disclosure is not limited thereto. Like reference numerals generally denote like elements throughout the present disclosure. Further, a detailed explanation of known technology relating to the present disclosure can be omitted if it unnecessarily obscures the subject matter of the present disclosure. The terms such as "including," "having," and "consist of" used herein are generally intended to allow other components to be added unless the terms are used with the term "only". Any references to singular can include plural unless expressly stated otherwise.

In construing an element, the element is construed as including an error range although there is no explicit description.

Spatially relative terms, such as "above", "upper", "lower", "besides", and the like can be used herein to describe that another element can be disposed between the first element and the second element unless "directly" is used.

When temporal relations are described using terms like "after", "subsequent to", "next", "before", etc., a case which is not continuous can be included unless 'just' or ' directly' is used.

The term "at least one" should be understood to include any combinations possible from one or more related items. For example, "at least one of a first item, a second item, and a third item" indicates each of the first item, the second item, or the third item, and also indicates any combinations of items possible from two or more of the first item, the second item, and the third item.

It will be understood that, although the terms "first", "second", and the like can be used herein to describe various components, however, these components should not be limited by these terms and do not define any order. These terms are only used to distinguish one component from another component. Thus, a first component described below can be a second component within the technical idea of the present disclosure.

Features of various embodiments of the present disclosure can be partially or overall coupled to or combined with each other, and can be variously inter-operated with each other and driven technically. The embodiments of the present disclosure can be carried out independently from each other or can be carried out together in co-dependent relationship.

Hereinafter, embodiments of the present disclosure will be described in detail with reference to the accompanying drawings.

Figure 2:
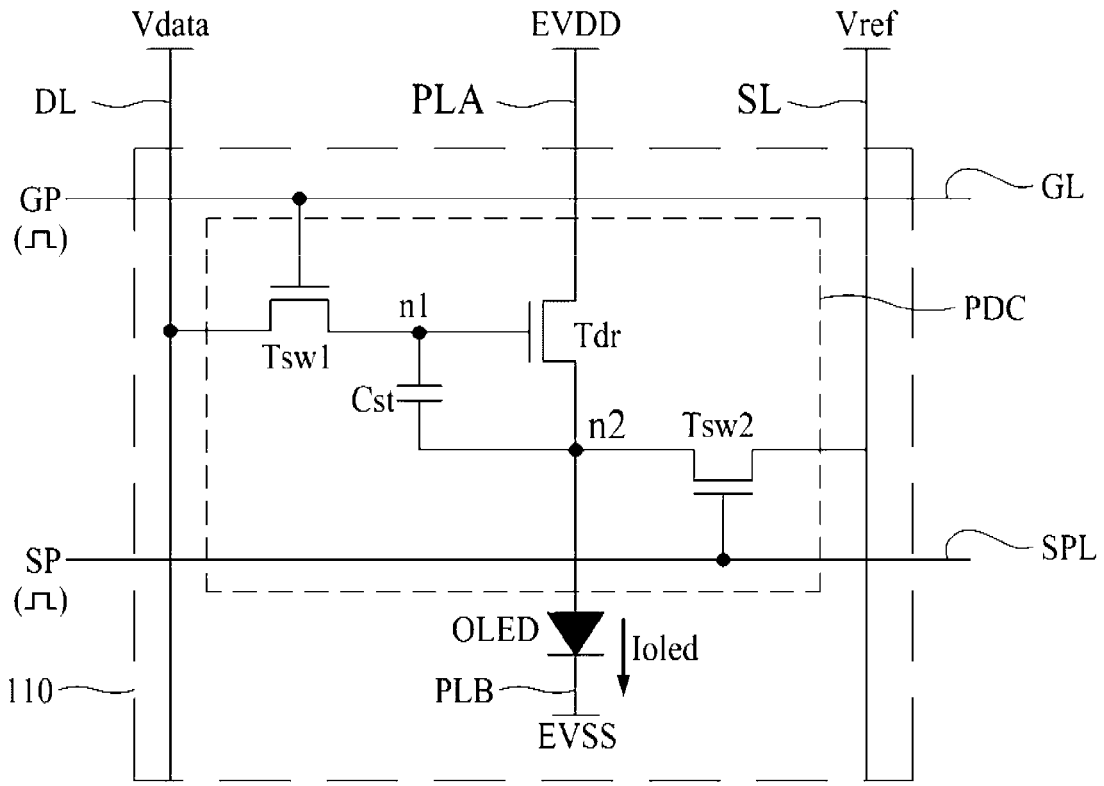
FIG. 2 is an exemplary diagram showing an example pixel of an organic light emitting display device according to the present disclosure.
Figure 3:
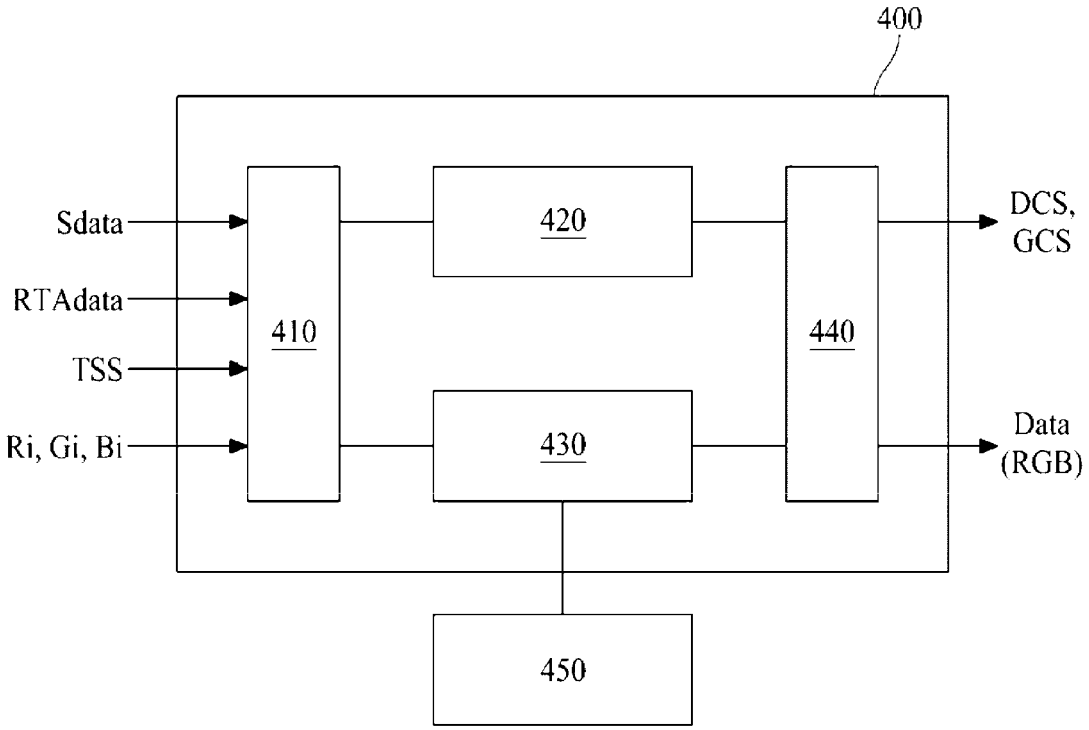
FIG. 3 is an exemplary diagram showing an example controller of an organic light emitting display device according to the present disclosure.
Figure 4:
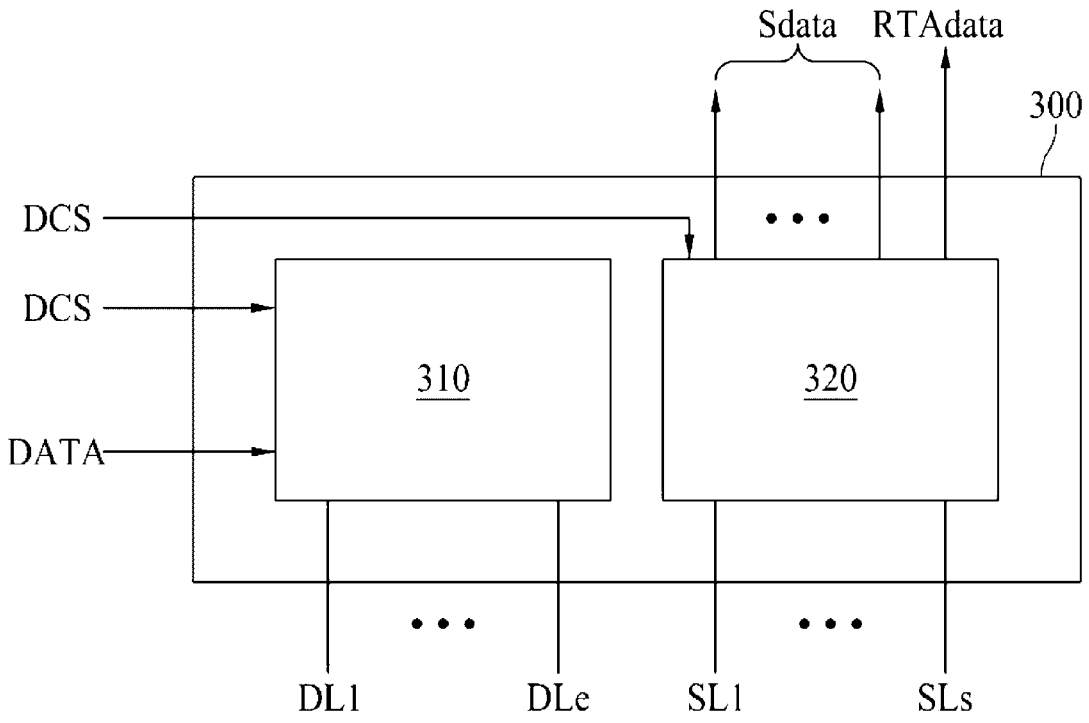
FIG. 4 is an exemplary diagram showing an example data driver IC of an organic light emitting display device according to the present disclosure.

FIG. 1 is an exemplary diagram showing an organic light emitting display device. FIG. 2 is an exemplary diagram showing a pixel of an organic light emitting display device. FIG. 3 is an exemplary diagram showing a controller of an organic light emitting display device. FIG. 4 is an exemplary diagram showing a data driver IC of an organic light emitting display device. All the components of the organic light emitting display device according to all embodiments of the present disclosure are operatively coupled and configured.

As shown in FIGS. 1 and 2, according to the present disclosure, the organic light emitting display device includes pixels 110 and each of the pixels 110 includes an organic light emitting diode (OLED) and a pixel driving circuit (PDC) to drive the OLED. The organic light emitting display panel 100 includes pixels 110 connected to sensing lines SL1 to SLk, a data driver with at least one data driver integrated circuit (IC) 300 configured to supply data voltage Vdata to the pixel driving circuit PDC of the pixel 110 through data lines DL1 to DLd disposed in the organic light emitting display panel 100 and connected to the sensing lines SL1 to SLk, a gate driver 200 configured to sequentially supply a gate pulse GP to gate lines GL1 to GLg disposed in the organic light emitting display panel 100, and a controller 400.

The controller 400 is configured to, in response to receiving a device off signal from an external system, control the data driver IC 300 in order for the data driver IC 300 to generate sensing data Sdata corresponding to a threshold voltage of each of driving transistors Tdr and at least one thermal property sensing data RTAdata corresponding to changes in properties of an analogue-to-digital converting portion of the data driver IC 300, in each horizontal line unit of the organic light emitting display panel 100, and to calculate an amount of changes in threshold voltages of the driving transistors Tdrs in each horizontal line unit based on the sensing data Sdata and the at least one thermal property sensing data RTAdata received through or received from the analogue-to-digital converter. The organic light emitting display device further includes a power supply 500 configured to supply power used to drive each of the data driver IC 300, the gate driver 200, and the controller 400.

When a plurality of thermal property sensing data are provided, for example, when the thermal property sensing data is sensed through a plurality of lines, the thermal property sensing data can be sensed at two or more different time points.

The data driver IC 300 can be disposed on a chip-on film 600 attached to the organic light emitting display panel 100. The chip-on film 600 is also connected to a main substrate 700 including a controller 400. In this case, the chip-on film 600 includes lines to electrically connect the controller 400, the data driver IC 300, and the organic light emitting display panel 100 and the lines are electrically connected to pads disposed on each of the main substrate 700 and the organic light emitting display panel 100. In some examples, the data driver IC 300 can be directly mounted on the organic light emitting display panel 100.

The horizontal line is a virtual line extending along a gate line GL and each of the pixels connected to the gate line GL can be disposed along that horizontal line. For example, the horizontal line described below can be a virtual line formed by pixels arranged in a row in a horizontal direction of the organic light emitting display panel 100 shown in FIG. 1.

The components are described below sequentially.

As shown in FIG. 2, the organic light emitting display panel 100 includes a pixel 110 with the organic light emitting diode OLED and a pixel driving circuit PDC. The organic light emitting display panel 100 includes signal lines to define a pixel region in which the pixels 110 are disposed and to supply a driving signal to the pixel driving circuit PDC.

The signal lines include a gate line GL, a sensing pulse line SPL, a data line DL, a sensing line SL, a first driving power line PLA, and a second driving power line PLB.

The gate lines GL are disposed along a second direction, for example, a horizontal direction of the organic light emitting display panel 100 and are spaced apart from each other by a predetermined distance, and are disposed in parallel.

The sensing pulse line SPL can be spaced apart from the gate line GL by a predetermined distance to be in parallel to the gate line GL.

The data lines DL are disposed along a first direction, for example, a vertical direction of the organic light emitting display panel 100 to cross each of the gate line GL and the sensing pulse line SPL are spaced apart from each other by a predetermined distance to be in parallel to one another. However, the arrangement of each of the data line DL and the gate line GL can be variously changed.

The sensing line SL can be spaced apart from the data line DL to be parallel to the data line DL. However, the present disclosure is not limited thereto. For example, at least three pixels 110 form one unit pixel. In this case, the unit pixel can include one sensing line SL. Accordingly, when d data lines DL1 to DLd are disposed on a horizontal line of the organic light emitting display panel 100, a number (k) of the sensing lines SL can be "d/4". In more detail, the data lines are disposed in the first direction (e.g., the vertical direction) of the organic light emitting display panel 100, and the sensing lines SL are disposed in parallel with the data lines. Each of the sensing lines SL can be connected to at least three pixels 110 constituting each of the unit pixels disposed on one horizontal line.

The first driving power line PLA can be spaced apart from each of the data line DL and the sensing line SL by a predetermined distance to be parallel to each of the data line DL and the sensing line SL. The first driving power line PLA is connected to the power supply 500 to supply the first driving power EVDD received from the power supply 500 to each pixel 110.

A second driving power EVSS received from the power supply 500 is supplied to each pixel 110 through the second driving power line PLB.

The pixel driving circuit PDC includes a driving transistor Tdr to control current flowing through the organic light emitting diode OLED and a switching transistor Tsw1 connected among the data line DL, the driving transistor Tdr, and the gate line GL. The pixel driving circuit PDC of each of the pixels 110 includes a capacitor Cst and a sensing transistor Tsw2 for external compensation or internal compensation.

The switching transistor Tsw1 is switched based on the gate pulse GP to output the data voltage Vdata supplied from the data line DL to a gate of the driving transistor Tdr.

The sensing transistor Tsw2 is switched based on the sensing pulse SP to supply a sensing voltage supplied to a sensing line SL to a second node n2 as a source electrode of the driving transistor Tdr.

The capacitor Cst charges the voltage supplied to the node n1 based on the switching of the switching transistor Tsw1 and switches the driving transistor Tdr based on the charged voltage.

The driving transistor Tdr is turned on based on the voltage of the capacitor Cst to control an amount of data current Ioled flowing from the first driving power line PLA to the OLED.

The OLED emits light based on the data current (Ioled) received from the driving transistor Tdr to emit light having luminance corresponding to the data current (Ioled).

In the above description, a structure of the pixel 110 having the sensing line SL for performing the external compensation or the internal compensation has been described with reference to FIG. 2, but the pixel 110 can have various types of structures with the sensing line SL as well as the structure shown in FIG. 2.

For example, the external compensation refers to calculating an amount of changes in threshold voltage or mobility of the driving transistor Tdr of the pixel 110 and changing a magnitude of the data voltage supplied to the unit pixel based on the amount of changes. Accordingly, the structure of the pixel 110 can be changed variously such that an amount of changes in the threshold voltage or the mobility of the driving transistor Tdr can be calculated. In this case, the sensing line SL can be provided.

The method of calculating an amount of changes in threshold voltage or mobility of the driving transistor Tdr using the pixel 110 for external compensation can also be variously changed according to the structure of the pixel 110.

In more detail, according to the present disclosure, when the threshold voltages of the driving transistors Tdr of the organic light emitting display panel 100 are sensed for external compensation, changes in characteristics due to the heat of the analogue-to-digital converting portion to sense the threshold voltages are sensed with the threshold voltages and the present disclosure is not directly related to the external compensation method.

Accordingly, the structure of the pixel for external compensation and the method of performing the external compensation can include various structures of pixels provided for external compensation and various methods of external compensation. For example, the structure of the pixel 110 for external compensation and the method for performing the external compensation can use structures and methods disclosed in published patents such as Korean Patent Laid-Open Publication No. 10-2013-0066449. Structures and methods disclosed in Korean Patent Application No. 10-2013-0150057 and Korean Patent Application No. 10-2013-0149213 filed by the applicant can also be used.

For example, the specific structures of the pixels for performing the external compensation and the specific method for performing the external compensation are exemplary case, and the scope of the present disclosure is not limited by specific external compensation method or structure. An example of a pixel for external compensation has been briefly described with reference to FIG. 2 and the external compensation method is also briefly described below.

In addition, the present disclosure can be applied to an organic light emitting display device including the sensing line SL and the sensing transistor Tsw2 for internal compensation. The structure of the pixel 110 having the sensing line SL for the internal compensation can also be changed in various forms and the internal compensation method can also be variously changed according to the structure of the pixel 110.

The organic light emitting display device that performs the external compensation is described below as an example of the present disclosure.

In some examples, the gate driver 200 sequentially supplies the gate pulse GP to each of the gate lines GL1 to GLg based on gate control signals GCS received from the controller 400.

The gate pulse GP refers to a signal for turning on the switching transistor Tsw1 connected to the gate lines GL1 to GLg. A signal capable of turning off the switching transistor Tsw1 is referred to as "a gate-off signal". The gate pulse GP and the gate-off signal are collectively referred to as "a gate signal".

The gate driver 200 is independent of the organic light emitting display panel 100 and can be electrically connected to the organic light emitting display panel 100 through a tape carrier package TCP, a chip on film COF, or a flexible printed circuit board (FPCB). In the case of a gate in panel GIP display device, the gate driver 200 can be directly mounted in the OLED 100.

In some examples, the power supply 500 supplies power to each of the gate driver 200, the data driver, and the controller 400.

In some examples, as shown in FIG. 3, the controller 400 generates a gate control signal GCS to control driving of the gate driver 200 and a data control signal DCS to control driving of the data driver 300 based on a timing synchronization signal TSS input from an external system.

In addition, in a sensing mode in which sensing for external compensation is performed, the controller 400 transmits, to the data driver, sensing image data to supply to pixels disposed on a horizontal line at which the external compensation is performed. The sensing for the external compensation can be performed at various timings. For example, the sensing for the external compensation related to changes in mobility of the driving transistors Tdr can be performed during a blanking period between frame periods.

When the sensing is performed, the controller 400 calculates external compensation values based on mobility sensing data received from the data driver and stores the external compensation values in a storage portion 450. The storage portion 450 can be included in the controller 400 or can be disposed at an outside of the controller 400 independently.

During a display period for which an image is output, the controller 400 compensates for input image data (Ri, Gi, Bi) received from the external system based on the external compensation value and converts the input image data into external compensation image data or realigns the input image data without external compensation and converts the input image data to image data to output. The data driver IC 300 converts the external compensation image data or the image data into data voltages Vdata and supplies the data voltages Vdata to each of the data lines DL1 to DLd.

In addition, when a device off signal is received from the external system, which indicates that an electronic device including the organic light emitting display device is turned off according to the present disclosure, the controller 400 controls the data driver IC 300 to generate the sensing data S data on threshold voltages of the driving transistors Tdr and at least one thermal property sensing data RTAdata on changes in properties due to a heat of the analogue-to-digital converting portion of the data driver IC 300 in each horizontal line unit of the organic light emitting display panel 100.

For example, the sensing data Sdata and the thermal property sensing data RTAdata are each generated for each horizontal line.

In more detail, sensing is performed to determine a property changes due to the heat of the analogue-to-digital converting portion to generate the sensing data Sdata when the threshold voltages of the driving transistors Tdr disposed in one horizontal line are sensed.

The data driver IC 300 transmits, to the controller 400, the sensing data Sdata generated in one horizontal line unit and the thermal property sensing data RTAdata generated with the sensing data Sdata.

In this case, the controller 400 can calculate an amount of changes in threshold voltages of the driving transistors Tdr in each horizontal line unit based on the sensing data Sdata and at least one thermal property sensing data RTAdata received through or received from the analogue-to-digital converting portion.

Examples of electronic devices can include televisions, monitors, tablet personal computers (PC), and smartphones.

A detailed method for generating the sensing data S data and the thermal property sensing data RTAdata is described below in detail with reference to FIGS. 5 and 6.

To perform the above function, as shown in FIG. 3, the controller 400 includes a data aligner 430 to realign input image data Ri, Gi, and Bi received from the external system based on a timing synchronization signal TSS received from the external system and to supply the realigned image data to the data driver IC 300, a control signal generator 420 to generate each of the gate control signal GCS and the data control signal DCS based on the timing synchronization signal TSS, a calculator 410 to calculate an external compensation value for compensating for changes in properties of the driving transistor Tdr disposed in each of the pixels 110 based on the sensing data Sdata and the thermal property sensing data RTAdata received from the data driver IC 300, a storage portion 450 to store the external compensation value, and an output portion 440 to output the image data Data (RGB) generated by the data aligner 430 and the control signals DCS and GCS generated by the control signal generator 420 to the data driver IC 300 or the gate driver 200. The storage portion 450 can be included in the controller. As shown in FIG. 3, the storage portion 450 can be independent of the controller 400. The data aligner 430 can convert the input image data to the image data based on the external compensation values.

Particularly, when the device off signal is received from the external system, the calculator 410 can control the control signal generator 420 to generate the data control signal DCS such that the data driver IC 300 generates the sensing data Sdata and the thermal property sensing data RTAdata in each horizontal line unit of the organic light emitting display panel 100. In this case, FIG. 1 shows two or more data driver ICs 300 and FIG. 4 shows one data driver IC 300. A number of sensing lines connected to one data driver IC 300 is less than a total number of sensing lines SL1 to SLk connected to the organic light emitting display panel. Thus, in FIG. 4, s is a natural number less than k.

When the control signal generator 420 generates the data control signal DCS, for example, a sensing control signal SAM under the control of the calculator 410 and transmits the generated data control signal DCS, for example, the sensing control signal SAM to the data driver IC 300, the data driver IC 300 converts the sensing voltages received from the sensing lines SL into the sensing data Sdata, which is a digital value, and transmits the converted sensing data to the controller 400, and generates the thermal property sensing data RTAdata with the sensing data SData and transmits the generated thermal property sensing data RTAdata with the sensing data SData to the controller 400.

The calculator 410 can also determine whether an event occurs in the organic light emitting display device based on the thermal property sensing data RTAdata received from or received through the analogue-to-digital converting portion of the data driver IC 300.

The calculator 410 may not determine an amount of changes in threshold voltages of the driving transistors disposed in an event horizontal line corresponding to the thermal property sensing data having a value exceeding a threshold value, if at least one of the thermal property sensing data sequentially generated in each horizontal line unit exceeds a predetermined threshold value.

The event refers to a cause that can affect characteristics of the analogue-to-digital converting portion of the data driver IC 300. For example, the event can be an inflow of a large amount of static electricity.

In more detail, when a user turns off the electronic device and then wipes the electronic device using a rag or the like, static electricity can occur in the electronic device, the sensing voltages and the analogue-to-digital converting portion can be damaged based on the static electricity, and the thermal property sensing data RTAdata value can also exceed the threshold value.

In this case, the sensing data Sdata generated by the analogue-to-digital converting portion are not normal values. Accordingly, when the external compensation values are generated based on the sensing data Sdata, abnormal external compensation values can be provided to pixels in the event horizontal line.

Therefore, the calculator 410 may not calculate an amount of changes in threshold voltages of driving transistors in the event horizontal line.

The event can include various situations as well as the inflow of the static electricity.

The calculator 410 can control the data driver IC 300 to generate the thermal property sensing data of the event horizontal line based on an elapse of a predetermined time period after receiving the thermal property sensing data of the remaining horizontal lines.

Thereafter, the calculator 410 can calculate an amount of changes in threshold voltages of the driving transistors in the event horizontal line based on the sensing data Sdata received from the data driver IC 300 and can generate external compensation values for the event horizontal line.

In some examples, the data driver includes at least one data driver IC 300. FIG. 1 shows an example organic light emitting display device including at least two data driver ICs 300.

Each of the data driver ICs 300 is connected to the data lines and the sensing lines and operates in a sensing mode, a display mode, or an off mode based on a control signal received from the controller 400. The display mode is a mode in which an image is output when the organic light emitting display device is driven, the sensing mode is a mode in which the mobility of the driving transistor is sensed between the display modes, and the off mode is a mode which is performed before the electronic devices are turned off and in which the threshold voltages of the driving transistor are sensed. The present disclosure is directly related to the off mode among the modes.

Each of the at least one data driver IC 300 includes a data power supplier 310 and a sensor 320 as shown in FIG. 4 and the data power supply 310 is connected to the data lines DL and the sensor 320 is connected to the sensing lines SL.

In the sensing mode, the data power supply 310 converts image data for mobility sensing received from the controller 400 into data voltages to sense an amount of changes in mobility of the driving transistors Tdr and supplies the data voltages to data lines connected to the data driver IC 300.

In the display mode, the data power supply 310 converts the image data Data received from the controller 400 in a horizontal line unit to a data voltage for outputting an image and supplies the data voltage to the data lines DL.

In the off mode, the data power supply 310 converts the sensing image data received from the controller 400 for sensing the threshold voltage into data voltages and supplies the data voltages to the data lines connected to the data driver IC 300.

In the sensing mode, the sensor 320 supplies voltages for mobility sensing to sensing lines connected to the sensor 320 and then receives signals corresponding to the sensing voltages. The sensor 320 converts the signals representing changes in mobility of the driving transistors Tdr included in the pixels 110 disposed on one horizontal line into mobility sensing data, which is a digital value. The sensor 320 provides the mobility sensing data to the controller 400. In this case, the controller 400 can calculate an external compensation value based on the mobility sensing data.

In the display mode, the sensor 320 can supply a voltage for driving the pixel driving circuit PDC to the pixels through the sensing lines SL.

In the off mode, the sensor 320 converts, when the sensing control signal is received from the controller 400, the sensing voltages received from the sensing lines into the sensing data Sdata which is a digital value, generates the thermal property sensing data (RTAdata), and transmits the sensing data Sdata and the thermal property sensing data (RTAdata) to the controller 400, in each horizontal line unit.

Figure 5:
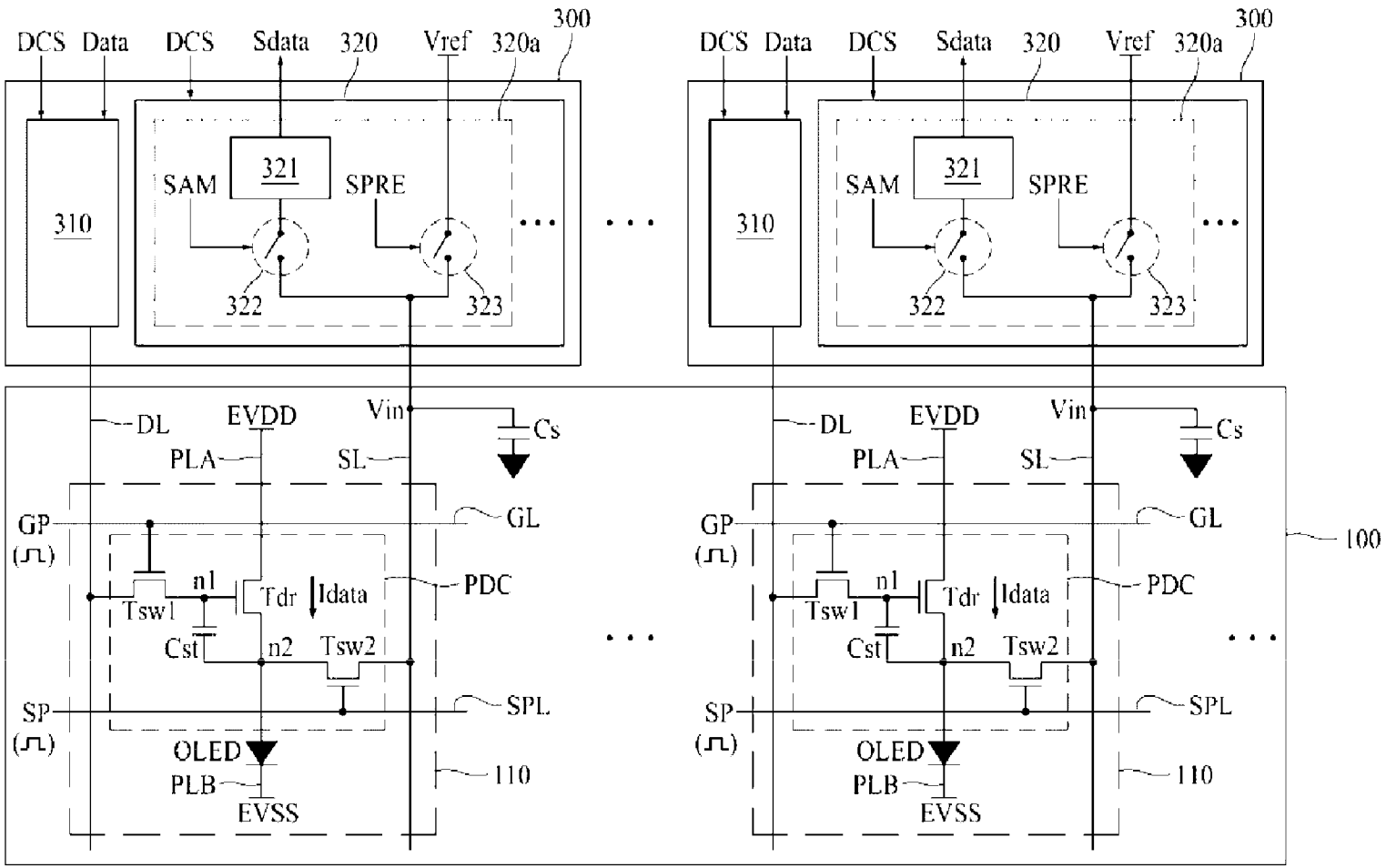
FIG. 5 is an exemplary diagram showing an example sensor of an organic light emitting display device according to the present disclosure.

FIG. 5 is an exemplary diagram showing a sensor of an organic light emitting display device.

In the off mode, for example, the electronic devices including the organic light emitting display devices are turned off, when the sensor 320 receives the sensing control signal SAM from the controller 400, the sensor 320 converts the sensing voltages received from the sensing lines into the sensing data Sdata which is the digital value, generates the thermal property sensing data RTAdata, and transmits the sensing data Sdata and the thermal property sensing data RTA data to the controller 400, in each horizontal line unit.

As shown in FIG. 5, the sensor 320 includes a plurality of sensing processors 320*a*.

Each of the sensing processors 320*a* converts the sensing voltage received from the sensing line SL to the sensing data Sdata and transmits the sensed voltage to the controller 400.

To this end, each of the sensing processors 320*a* includes a first switch 322, a second switch 323, and an analogue-to-digital converter 321. The first switch 322 is connected to at least one of the sensing lines SL1 to SLK and is turned on and turned off based on the sensing control signal SAM. The second switch 323 is connected to the sensing line SL connected to the first switch 322 and the power supply 500 to supply a reference voltage Vref and is turned on and turned off based on a reference voltage supply control signal SPRE. The analogue-to-digital converter 321 is connected between the controller 400 and the first switch 322 and converts the sensing voltage received through the first switch 322 into the sensing data Sdata and transmits the sensing data Sdata to the controller 400.

The first switch 322 and the second switch 323 can each be a thin film transistor switch.

In this case, in the off mode, the sensing control signal SAM can be supplied to a gate of the thin film transistor of the first switch 322 and the reference voltage supply control signal SPRE can be supplied to a gate of the thin film transistor of the second switch 323. The sensing control signal SAM and the reference voltage supply control signal SPRE are each data control signals DCS received from the control signal generator 420 of the controller 400.

The first switch 322 and the second switch 323 can each be turned on and turn off based on various control signals even in the sensing mode and the analogue-to-digital converter 321 converts the mobility sensing voltage received from the first switch 322 to the mobility sensing data and transmits the mobility sensing data to the controller 400. The mobility sensing data generated in the sensing mode can be used to determine an amount of changes in mobility of the driving transistor Tdr. For example, the mobility sensing data generated by the data driver IC 300 in the sensing mode is used to determine an amount of changes in mobility and the sensing data Sdata generated from the data driver IC 300 in the off mode can be used to determine the amount of changes in threshold voltage of the driving transistor Tdr.

The first switch 322 and the second switch 323 can each be turned on and turned off based on various control signals even in the display mode and various voltages received from the power supply 500 through the second switch 323 can be supplied to the sensing line SL.

The first switch 322 and the second switch 323 can each be turned on and turned off based on the sensing control signal SAM and the reference voltage supply control signal SPRE in the off mode and the analogue-to-digital converter 321 converts the sensing voltage received from the first switch 322 into the sensing data S data and can transmit the sensing data Sdata to the controller 400.

Figure 6:
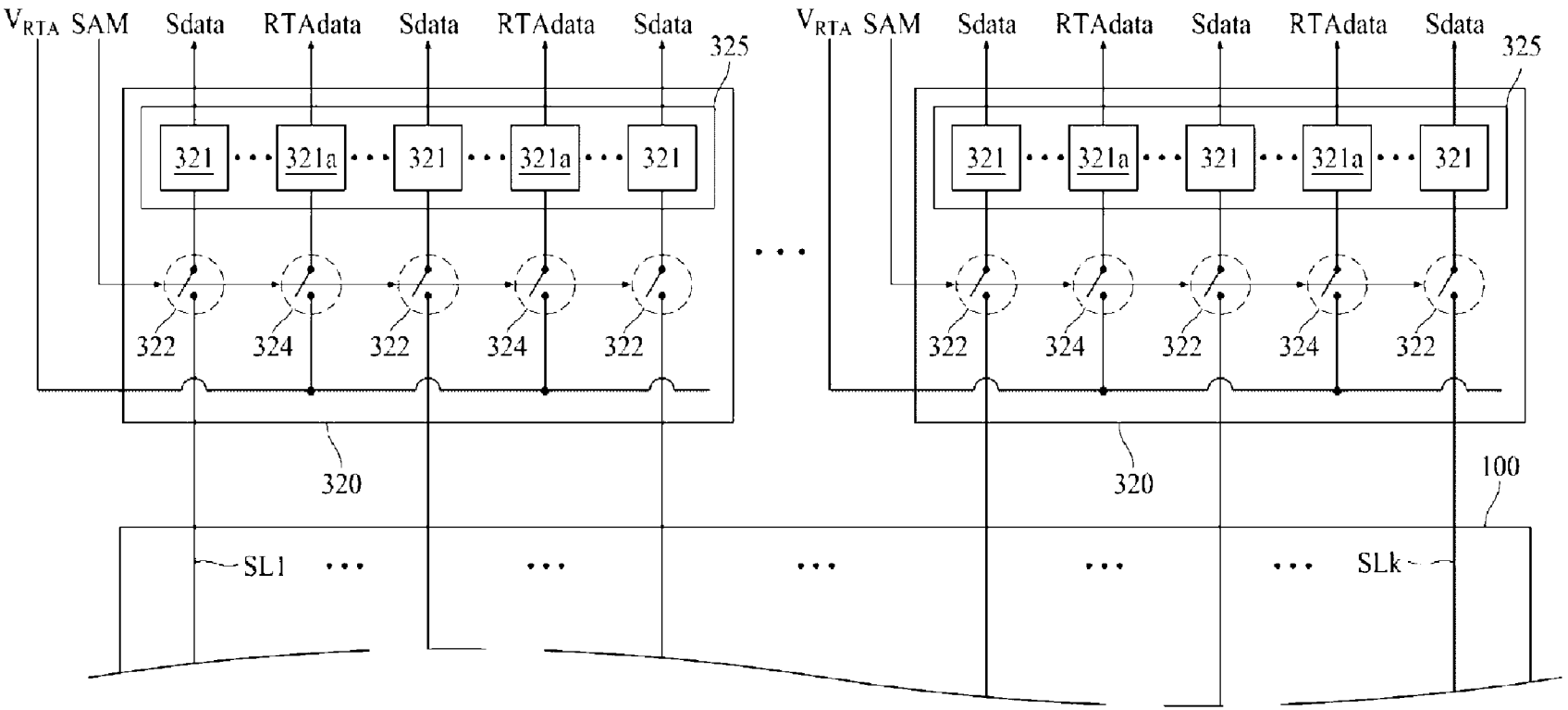
FIG. 6 is an exemplary diagram showing an analogue-to-digital converting portion of the sensor in FIG. 5.

FIG. 6 is an exemplary diagram showing an analogue-to-digital converting portion of the sensor in FIG. 5.

The data driver IC is configured as an example of integrated circuits and the sensing processor 320*a* is also configured as an example of integrated circuits.

Referring to FIG. 5, the analogue-to-digital converter 321 is individually provided in each of the sensing processors 320*a* and each of the analogue-to-digital converters 321 can be included in a component with an integrated circuit, for example, an analogue-to-digital converting portion 325.

For example, the analogue-to-digital converting portion 325 can include the analogue-to-digital converter 321 provided in each of the sensing processors 320*a*.

In more detail, the analogue-to-digital converting portion 325 can be a component of the sensor 320, and the analogue-to-digital converting portion 325 refers to a set of analogue-to-digital converters 321.

In this case, the analogue-to-digital converting portion 325 includes at least one analogue-to-digital digital converter 321*a* to generate the thermal property sensing data RTAdata.

The analogue-to-digital converter for thermal property 321*a* is connected to a third switch 324 that is turned on and turned off based on the sensing control signal SAM and the analogue-to-digital converter for thermal property 321*a* converts the thermal property sensing voltage VRTA received from the third switch 324 into the thermal property sensing data RTAdata, and transmits the thermal property sensing data RTAdata to the controller 400. For example, the thermal property sensing voltage VRTA can be a direct voltage (DC) of 5 V.

The third switch 324 is provided in the sensor 320.

In more detail, one data driver IC 300 includes one sensor 320 and the sensor 320 includes a plurality of sensing processors 320*a*. Each of the sensing processors 320*a* includes the analogue-to-digital converter 321 and the first switch 322.

One data driver IC 300 includes at least one third switch 324 and at least one analogue-to-digital converter for thermal property 321*a* as well as the sensing processor 320*a*.

In this case, the analogue-to-digital converting portion 325 includes the analogue-to-digital converters 321 and at least one analogue-to-digital converter for thermal property 321*a* provided in the data driver IC 300.

In some cases where the organic light emitting display device according to the present disclosure includes two or more data driver ICs 300, each of the data driver ICs 300 includes the analogue-to-digital converting portion 325.

The changes in characteristics due to heat are determined by each of the analogue-to-digital converting portions 325. Accordingly, when two or more analogue-to-digital converters for thermal property 321*a* are provided, an amount of changes in thermal properties of the analogue-to-digital converting portion 325 can be determined based on the thermal property sensing data RTAdata generated by at least two analogue-to-digital converters for thermal property 321*a*.

A position and a number of analogue-to-digital converters for thermal property 321*a* can be variously changed according to performance and sizes of the analogue-to-digital converting portion 325.

The switches 322 and the at least one third switch 324 are each turned on and turned off based on the sensing control signal SAM.

In the off mode, when the first switch 322 is turned on based on the sensing control signal SAM, the sensing voltage transmitted through the sensing line SL is transmitted to the analogue-to-digital converter 321 through the first switch 322 and is converted into the sensing data Sdata.

In the off mode, when the third switch 324 is turned on based on the sensing control signal SAM, the thermal property sensing voltage VRTA received from the power supply 500 is transmitted to the analogue-to-digital converter for thermal property 321*a* through the third switch 324 and is converted into the thermal property sensing data RTAdata.

The characteristics of the IC are easily changed due to the heat, and in particular, the characteristics of the analogue-to-digital converting portion 325 can be easily changed due to the heat, and the analogue-to-digital converting portion 325 converts the sensing voltage and the thermal property sensing voltage VRTA received through the sensing lines SL into the sensing data Sdata and the thermal property sensing data RTAdata which are the digital signals.

Therefore, when external compensation values are generated based only on the sensing data Sdata without considering changes in characteristics of the analogue-to-digital converting portion 325 due to the heat, incorrect compensation can be performed.

For example, when the organic light emitting display device is continuously driven, a temperature of the organic light emitting display device is increased and a temperature of the analogue-to-digital converting portion 325 is also increased.

When an image is not output through the organic light emitting display device based on the received off signal, the temperature of each of the organic light emitting display panel 100 and the analogue-to-digital converting portion 325 is sequentially lowered.

Therefore, when the threshold voltages of the driving transistors in each horizontal line are sensed after the off signal is received, if the sensing is performed from an upper portion to a lower portion of the organic light emitting display panel 100 shown in FIG. 1, a temperature of the analogue-to-digital converting portion 325 determined when the sensing data Sdata at the driving transistor Tdr in the first horizontal line corresponding to the first gate line GL1 disposed at the upper portion of the organic light emitting display panel 100 is generated is greater than a temperature of the analogue-to-digital converting portion 325 determined when the sensing data Sdata at the driving transistor in a g-th horizontal line corresponding to a g-th gate line GLg disposed at the lower portion of the organic light emitting display panel is generated.

In this case, as the characteristic of the analogue-to-digital converting portion 325 changes according to temperatures, two values of two pieces of sensing data S data output from the analogue-to-digital converting portion 325 can be different from each other even if the sensing voltage received from the driving transistor in the first horizontal line is identical to the sensing voltage received from the driving transistor in the g-th horizontal line.

To prevent this, in the present disclosure, when the sensing voltage sensed at the first horizontal line is transmitted to the analogue-to-digital converter 321 through the first switch 322, the thermal property sensing voltage VRTA is received at the analogue-to-digital converter for thermal property 321*a* through the third switch 324 and the sensing data Sdata generated by the analogue-to-digital converter 321 and the thermal property sensing data RTAdata generated by the analogue-to-digital converter for thermal property 321*a* are transmitted to the controller 400 at the same time.

When the sensing data and the thermal property sensing data are received, the controller 400 determines whether the abnormality of the analogue-to-digital converting portion 325 occurs based on the thermal property sensing data.

For example, if the characteristics of the analogue-to-digital converting portion 325 are changed due to the heat, the thermal property sensing data RTAdata may not be accurately match with the thermal property sensing voltage VRTA, for example, the thermal property sensing voltage VRTA of 5 V and a deviation value can be generated.

Accordingly, the controller 400 can calculate an external compensation value used for pixels in the horizontal line based on the deviation value and the sensing data Sdata.

In the same manner, when the sensing voltage sensed at the g-th horizontal line is received at the analogue-to-digital converter 321 through the first switch 322, the thermal property sensing voltage VRTA is transmitted to the analogue-to-digital converter for thermal property 321*a* through the third switch 324 and the sensing data Sdata generated by the analogue-to-digital converter 321 and the thermal property sensing data RTAdata generated by the analogue-to-digital converter 321*a* for thermal property are transmitted to the controller 400 at the same time.

In this case, when the sensing data and the thermal property sensing data are received, the controller 400 can calculate the deviation value by analyzing the thermal property sensing data and the thermal property sensing voltage VRTA.

When the deviation value is calculated, the controller 400 can calculate an external compensation value used for pixels in the g-th horizontal line based on the deviation value and the sensing data Sdata.

According to the present disclosure, when the external compensation values are calculated in each horizontal line unit, changes in characteristics due to the temperature of the analogue-to-digital converting portion 325 can be detected when the horizontal line is sensed. The external compensation values used for the pixels of the horizontal line can be calculated based on changes in characteristics due to the temperature of the analogue-to-digital converting portion 325.

Therefore, according to the present disclosure, correct external compensation values can be calculated in each horizontal line unit. In addition, according to the present disclosure, in some cases where at least two data driver ICs 300 are used, the changes in characteristics due to the heat of the analogue-to-digital converting portion 325 of each data driver IC 300 can be determined in independent of the data driver IC 300 such that more correct external compensation values can be calculated.

In some examples, temperature deviations can occur due to the changes in characteristics due to the heat. The deviation can cause an increase in noise and a method for reducing the temperature deviation is described in detail.

Figure 7:
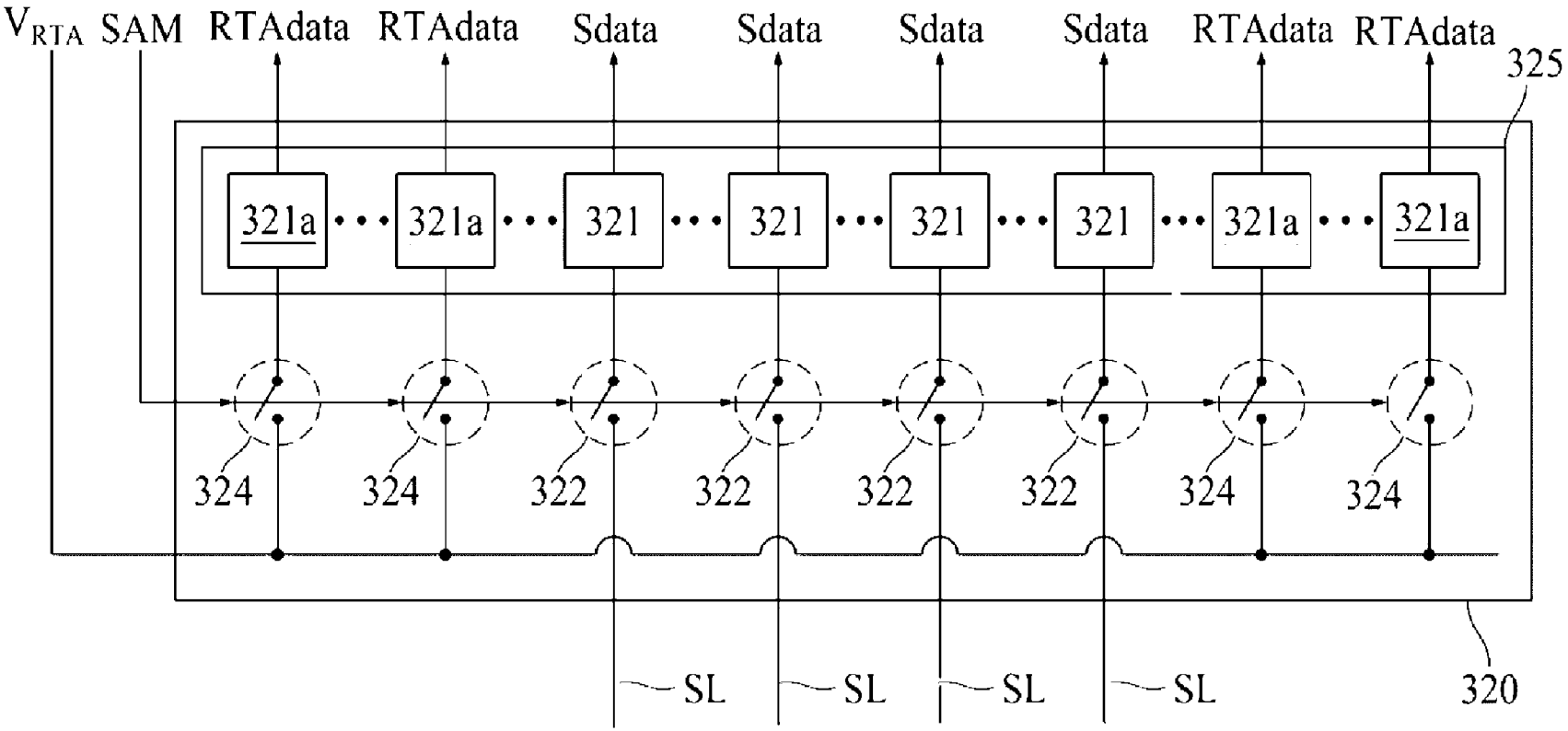
FIG. 7 is an exemplary view showing an example line for sensing thermal property sensing data RTAdata disposed at an outside of an analogue-to-digital converting portion according to the present disclosure.

FIG. 7 shows an example line for sensing thermal property sensing data (RTAdata) disposed at an outside of an analogue-to-digital converting portion. The line for sensing the thermal property sensing data is hereinafter referred to as "a dummy line". Alternatively, the dummy lines can be referred to as "dummy channels". FIG. 6 shows at least one dummy line disposed between the sensing lines SL. FIG. 7 shows at least one dummy line disposed at an edge of an analogue-to-digital converting portion 325 and sensing lines SL disposed between the dummy lines.

Even when at least one of the configuration of FIG. 6 or the configuration of 7 is used, noise can be generated during sensing of the thermal property sensing data RTAdata at the dummy line. For example, the same deviation can occur in all sensing values of the dummy channel when power noise is flowed into the thermal property sensing voltage VRTA if the sensing is performed only once at the same time point.

For example, during an off real-time sensing (OFFRS) compensation process to calculate and compensate for changes in a threshold voltage or mobility of a driving transistor Tdr of a pixel driving circuit PDC of the panel when the OLED TV is powered off, the temperature deviation can occur in each data IC 300. In this case, an offset deviation of the analogue-to-digital converter 321 of the data driver IC 300 occurs.

When an offset difference between the analogue-to-digital converters 321 of the data driver ICs 300 occurs and the deviation occurs in the sensing value, a blockdim phenomenon occurs between the converters. The blockdim can be removed or reduced by adding a real time ADC offset compensation (RTAOC) function as shown in FIG. 6 or 7 to use the offset characteristics of the analogue-to-digital converter 321 reflecting the temperature of the data driver IC 300 in real time.

However, during sensing of every line, when the dummy channels for RTAOC, for example, lines for sensing RTAdata are sampled once at the same time, horizontal line defect can occur on a front surface of a screen due to the deviation in sensing value resulting from power noise deviation for each line.

Accordingly, in the present disclosure, to remove or reduce this phenomenon, a discrete sampling function is performed to reduce the power noise to thereby eliminate the front horizontal line defect phenomenon.

The discrete sampling can be used in both the embodiment in which the dummy line and the sensing line are intersect with each other as shown in FIG. 6 and the embodiment in which the dummy line and the sensing line form a group as shown in FIG. 7.

An example of noise generated when only one sensing is performed without performing the discrete sampling is described.

Figure 8:
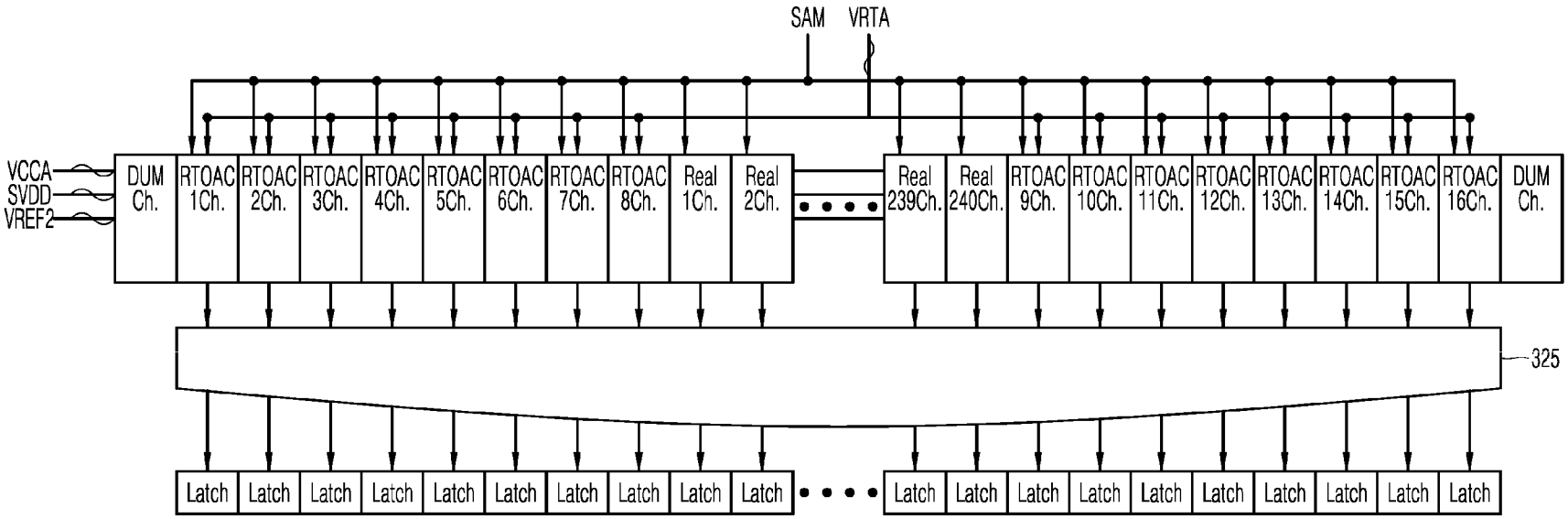
FIG. 8 is an exemplary diagram showing a plurality of arranged RTAOC dummy channels and applied signals according to the present disclosure.

FIG. 8 shows an example of a plurality of arranged RTAOC dummy channels and applied signals. The configuration method and a number of channels or lines in FIG. 8 can be variably used.

FIG. 8 shows a total of arranged 16 RTAOC channels for thermal property sensing data and a total of arranged 240 real channels for sensing data. The RTAOC channels are divided into 8 RTAOC channels and are arranged at both sides of the actual channel, which is an example of the configuration of FIG. 7.

In the configuration of FIG. 8, a sampling signal SAM and thermal property sensing data VRTA are applied and signals such as VCCA/SVDD/VREF2 are applied. The thermal property sensing voltage VRTA can be about 5V, for example, 4.5V, but this is an exemplary value and various magnitudes of voltages can be applied.

An OLED TV model can correct an offset value of an ADC 325 determined based on changes in temperatures of the data driver IC 300 based on the thermal property sensing data, which is a value sensed through the RTAOC dummy channel in real time during OFFRS sensing and compensation for each line. This is referred to as "an RTAOC function" and a line for sensing the thermal property sensing data is referred to as "an RTAOC dummy channel".

However, as every line is sensed only once at the same time through the RTAOC dummy channels, when power noise is introduced into VRTA input voltage, the same deviation (Δnoise) occurs in all sensing values of the RTAOC dummy channel.

In addition, if the values are averaged and the averaged value is added to the sensing value obtained through OFFRS of the real channel and a level difference in noise occurs in each line, the horizontal line defect can occur on the front surface of the screen after the OFFRS compensation. This configuration is described in FIG. 9.

Figure 9:
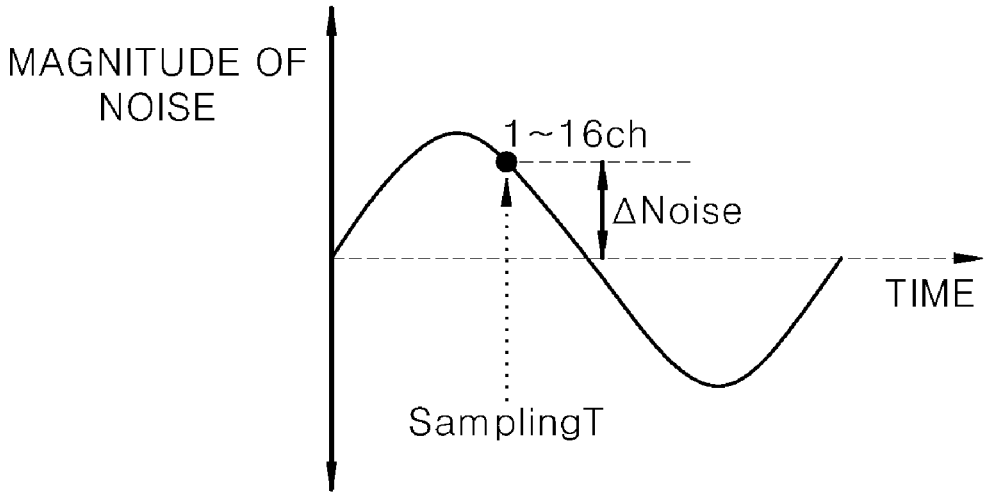
FIG. 9 is a graph showing noise when VRTA is applied and sampled to a RTAOC dummy channel according to the present disclosure.

FIG. 9 is a graph showing noise when VRTA is applied and sampled to an RTAOC dummy channel. If sampling is performed at the same time point in the RTAOC dummy channel in one data driver IC 300, for example, the sampling is preformed only once, the same noise can exist in all channels.

For example, noise fluctuation (Δnoise) of 16 dummy channels exists at a sampling time point (SamplingT). This corresponds to noise determined when averaging all channels. This is shown in Equation 1.

$$\begin{aligned}RTAOC_SEN_Avg=&(RTAOC1+\Delta N)+(RTAOC2+\\&\Delta N)++(RTAOC15+\Delta N)+(RTAOC16+\Delta N)\}\div 16=\\&(RTAOC1+RTAOC2+\ldots+RTAOC15+\\&RTAOC16)\div 16+\Delta N\end{aligned} \quad \text{[Equation 1]}$$

For example, noise fluctuation (ΔN) is used to calculate an average without change. Therefore, when the sampling time points of the RTOAC dummy channels are all the same, a front horizontal line defect can occur due to the noise.

Therefore, the sampling time points of the dummy channels can be different to remove the noise.

In one embodiment of the present disclosure, a process of performing sampling at different time points is described.

Figure 10:
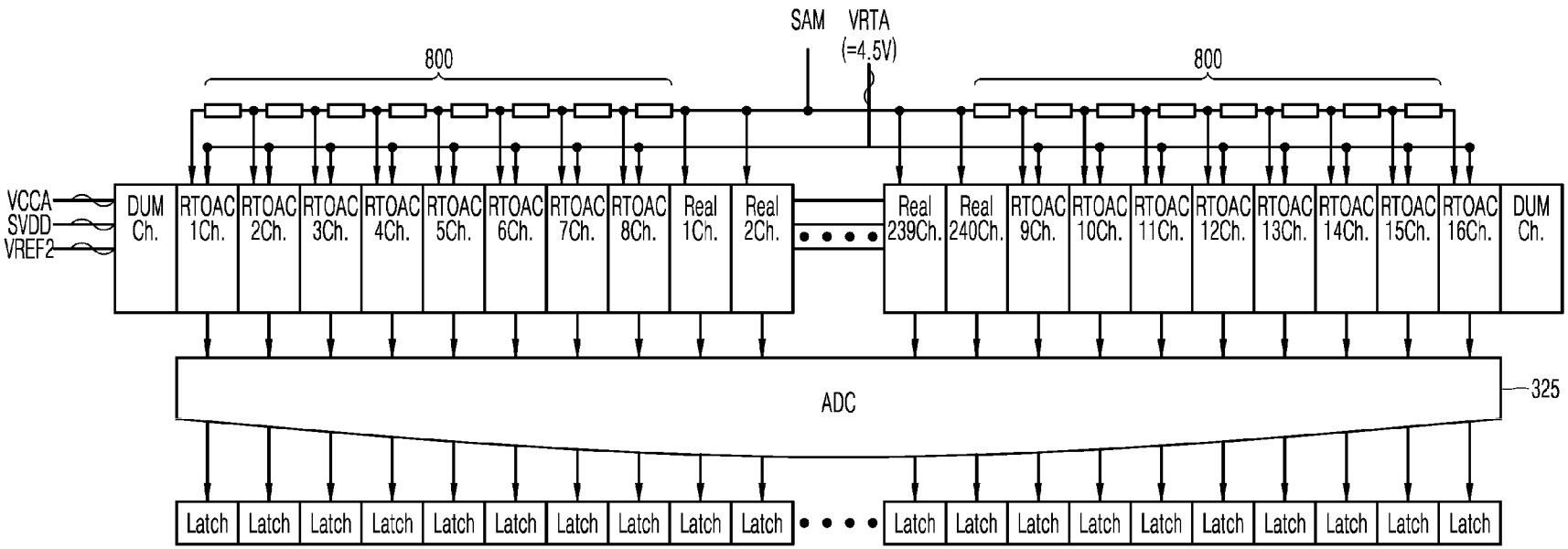
FIG. 10 is an exemplary diagram showing example different sampling time points of RTAOC channels according to the present disclosure.

FIG. 10 shows example different sampling time points of RTAOC channels. FIG. 10 shows a plurality of arranged RTAOC dummy channels and applied signals. The configuration method and a number of channels or lines of FIG. 10 can be variably used.

In the configuration of FIG. 10, a discrete sampling enabler 800 is disposed in a data driver IC to perform sampling at different sampling time points in an input section of the RTAOC dummy channel. The discrete sampling enabler 800 can prevent a front horizontal line noise phenomenon occurring based on deviations in power noise by performing the RTAOC during OFFRS sensing.

For example, when the discrete sampling enabler 800 is disposed, the sampling time points of RTAOC dummy channels can be different. As a result, an amount of noise sensed between the channels is different and as the noise has an AC component, the sensing values of all RTAOC dummy channels can be averaged to reduce or eliminate the noise, to thereby reduce an impact on the power noise by performing the RTAOC function during the OFFRS compensation.

The discrete sampling enabler 800 adjusts sampling times points differently and can be disposed in a data driver IC 300, for example, a sensor 320. The discrete sampling enabler 800 can be disposed on a routing line of a SAM signal as a resistor or a flip-flop, to spread the SAM signal.

The discrete sampling enabler 800 discretely samples the thermal property sensing data at two or more different time points.

Figure 11:
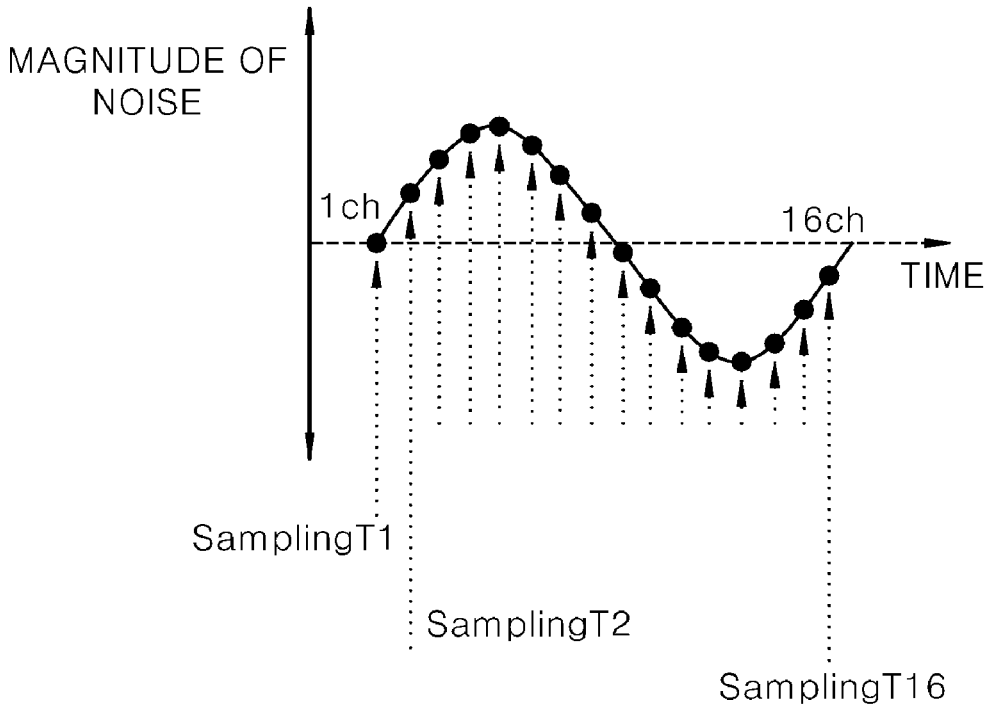
FIG. 11 is a graph showing example different time points at which VRTA is applied and sampled to a RTAOC dummy channel according to the present disclosure.

FIG. 11 is a graph showing an example of different time points at which VRTA is applied and sampled to a RTAOC dummy channel. In some cases where a total of 16 dummy channels are provided, sampling time points are sequential. Accordingly, the sampling is sequentially performed from a first channel 1*ch* to a 16th channel 16*ch*. For example, the first channel is sampled at a time point of Sampling_T1, the second channel is sampled at a time point of Sampling_T2. Similarly, the 16th channel is sampled at a time point of Sampling_T16.

Different noises exist for each dummy channel and noise can be reduced by averaging when the noises of the respective channels. In the best case, noise can converge to zero. This is described in Equation 2.

$$\begin{aligned}\text{RTAOC_SEN_Avg} = \quad & \text{[Equation 2]}\\ & \{(RTAOC1 + \Delta N1) + (RTAOC2 + \Delta N2) + \ldots + \\ & (RTAOC15 + \Delta N15) + (RTAOC16 + \Delta N16)\} \div 16 = \\ & (RTAOC1 + RTAOC2 + \ldots + RTAOC15 + RTAOC16) \div \\ & 16 + (\Delta N1 + N2 + \ldots + \Delta N15 + \Delta N16) \div 16(\approx 0) = \\ & (RTAOC1 + RTAOC2 + \ldots + RTAOC15 + RTAOC16) \div \\ & 16\end{aligned}$$

The noise can converge to "0" because AC components of the noise are accumulated due to different sampling time points of the dummy channels.

Figure 12:
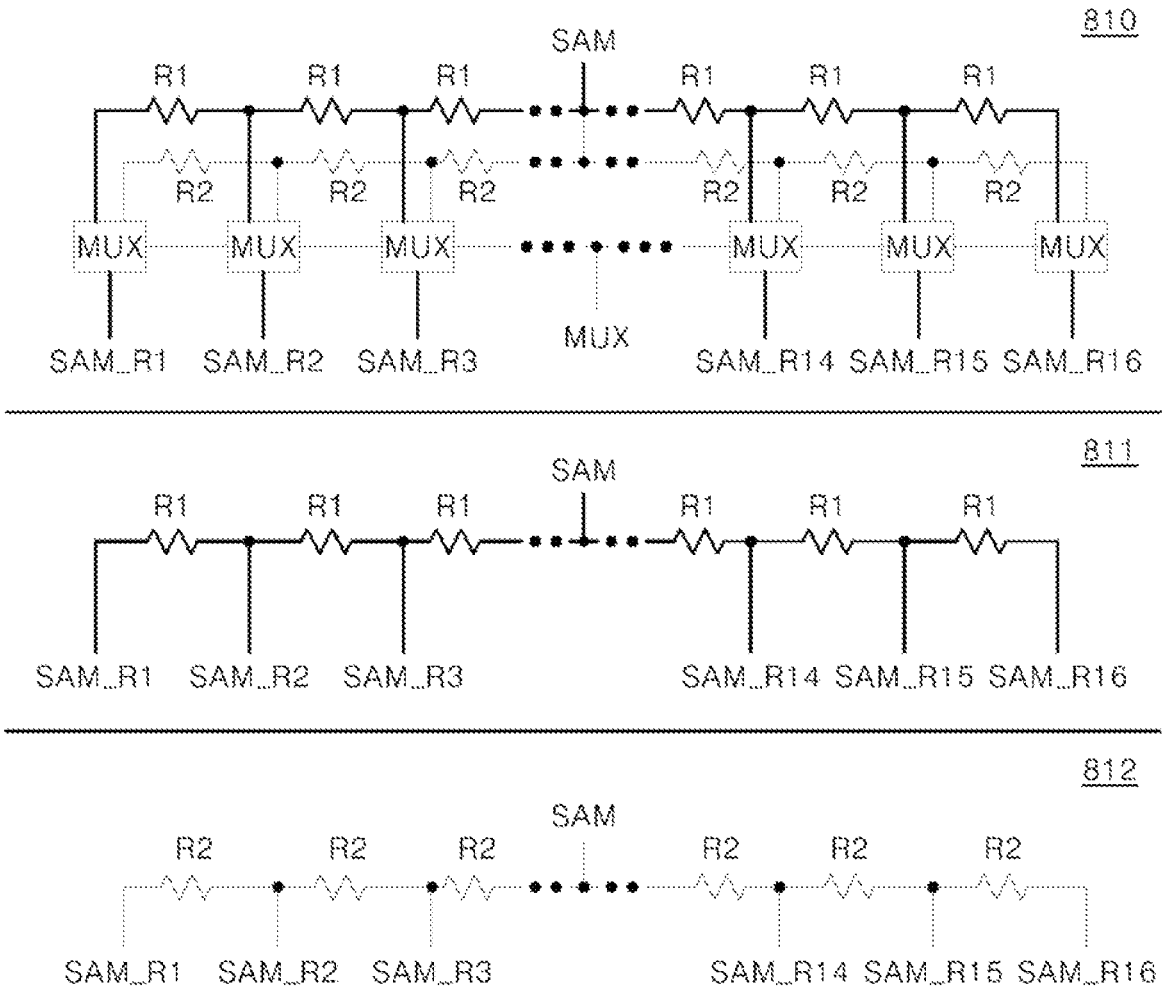
FIG. 12 is an exemplary diagram showing an example asynchronous discrete sampling enabler according to the present disclosure.

FIG. 12 shows an example asynchronous sampling discrete enabler. An asynchronous discrete sampling enabler 810 places a resistor R1 on a sampling signal line of each dummy channel. SAM_R1, SAM_R2, . . . , SAM_R16 are dummy lines.

If multiplexers (MUXs) are arranged such that it can be selected according to frequency characteristics of power noise, the noise generated in the RTAOC dummy channel can be reduced by varying the sampling intervals of the RTAOC dummy channels, thereby minimizing the front horizontal line defect caused due to power noise.

The discrete sampling enabler 810 of FIG. 12 includes a number of MUXs, resistors connected to the MUXs, and dummy lines connected to the MUXs. Some or all of N dummy lines to sense the thermal property sensing data are respectively connected to a third terminal of each MUX. In addition, a resistor R1 is provided at a first terminal of each MUX. In addition, a second resistor R2 is provided at a second terminal of each MUX.

In addition, the third terminal of the MUX is connected to at least one of the first terminal of the MUX or the second terminal of the MUX based on a selection signal SAM_SEL applied to the MUX. For example, the discrete sampling enabler connects the third terminal of the MUX to at least one of the first terminal of the MUX or the second terminal of the MUX based on the signal applied to the MUX. A data driver IC can sense thermal property sensing data sensed at N dummy lines at two or more different time points.

A plurality of first resistors R1 are connected to one another electrically in series. A plurality of second resistors R2 are connected to one another electrically in series. One end of each of the resistors is connected to a sampling signal line SAM.

In reference numeral 811, FIG. 12 shows a first terminal of a MUX connected to a dummy line based on SAM_SEL. The MUX and the R2 are omitted in reference numeral 811 of FIG. 12. The sampling signal line SAM is connected to a line connecting the first resistors R1 and thermal property sensing data of each of dummy lines SAM_R1, SAM_R2, . . . , SAM_R16 is determined.

In reference numeral 812, FIG. 12 shows a second terminal of an MUX connected to a dummy line based on a SAM_SEL. The MUX and an R1 are omitted in reference numeral 812 of FIG. 12. A sampling signal line SAM is connected to a line connecting second resistors R2 and the thermal property sensing data of each dummy line SAM_R1, SAM_R2, . . . , SAM_R16 is determined.

Figure 13:
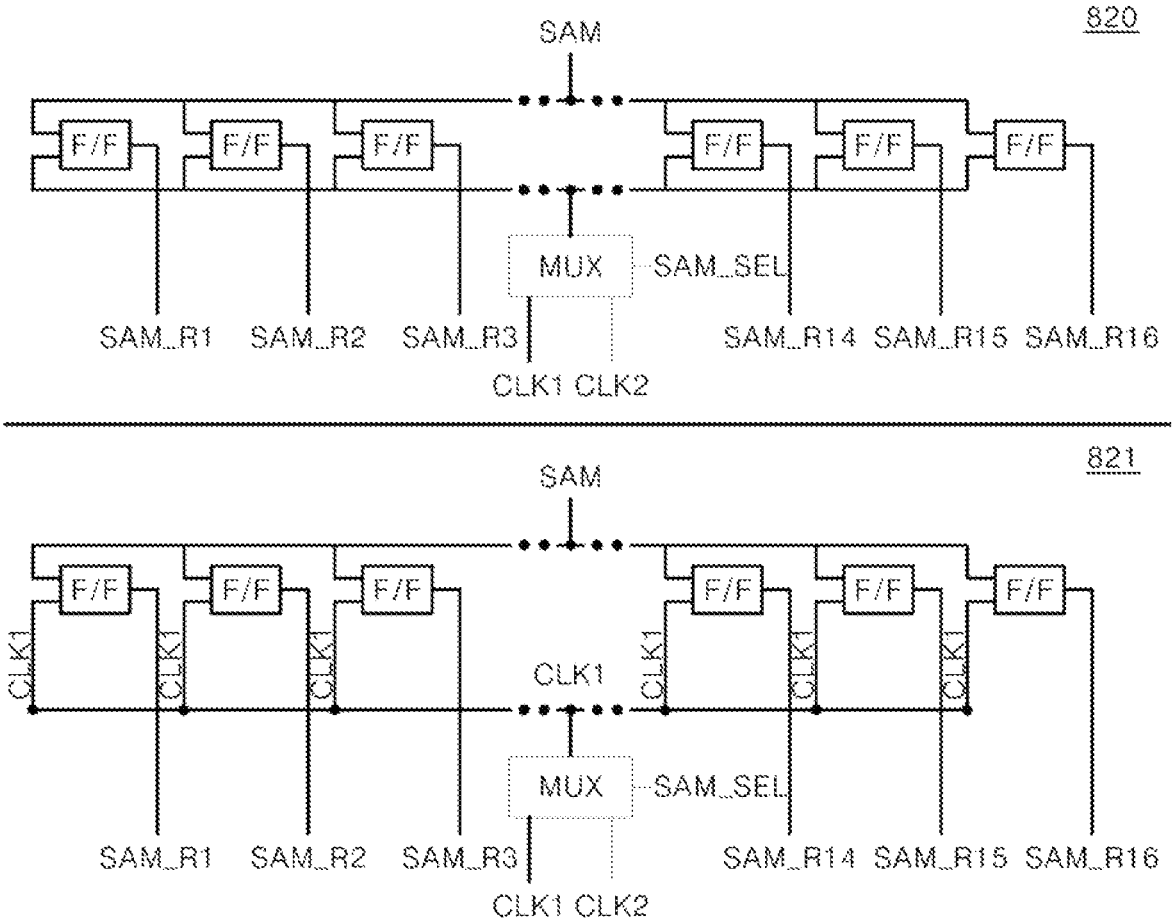
FIG. 13 is an exemplary diagram showing an example synchronous discrete sampling enabler according to the present disclosure.

FIG. 13 shows an example synchronous discrete sampling enabler. A synchronous discrete sampling enabler 820 places at least one flip-flop (F/F) on at least one sampling signal line of at least one dummy channel.

If the MUX is arranged such that it can be selected according to frequency characteristics of power noise, the noise generated in the RTAOC dummy channel can be reduced by changing sampling intervals of the RTAOC dummy channels, thereby minimizing a front horizontal line defect due to power noise. SAM_R1, SAM_R2, . . . , SAM_R16 are dummy lines.

The discrete sampling enabler 820 includes at least one flip-flop (F/F). Some or all of the N dummy lines for sensing the thermal property sensing data are respectively connected to third terminals of flip-flops and a first terminal of each flip-flop is connected to a sampling signal line. A second terminal of the flip-flop is connected to the third terminal of an MUX.

In some examples, a first synchronization signal CLK1 is applied to the first terminal of the MUX and a second synchronization signal CLK2 is applied to the second terminal of the MUX. The third terminal of the MUX is connected to at least one of the first terminal or the second terminal based on a selection signal SAM_SEL applied to the MUX. For example, the discrete sampling enabler connects the third terminal of the MUX to at least one of the first terminal of the MUX or the second terminal of the MUX based on the signal applied to the MUX.

The data driver IC can sense the thermal property sensing data at the N dummy lines based on at least one of a first synchronization signal CLK1 or a second synchronization signal CLK1 at two or more different time points.

In reference numeral 821, a first synchronization signal CLK1 is applied.

Referring to FIGS. 12 and 13, the sampling signal SAM is disposed at a central portion. SAM_R8 and SAM_R9 corresponding to the dummy sampling channels 8 and 9 disposed at a central portion are sampled first and SAM_R1 and SAM_R16 corresponding to dummy sampling channels 1 and 16 disposed at edges are sampled last.

In addition, in FIGS. 12 and 13, when a low signal is applied to the MUX, a sampling interval for each dummy channel is reduced or narrowed and when a high signal is applied to the MUX, a sampling interval for each dummy channel is increased or widened.

Figure 14:
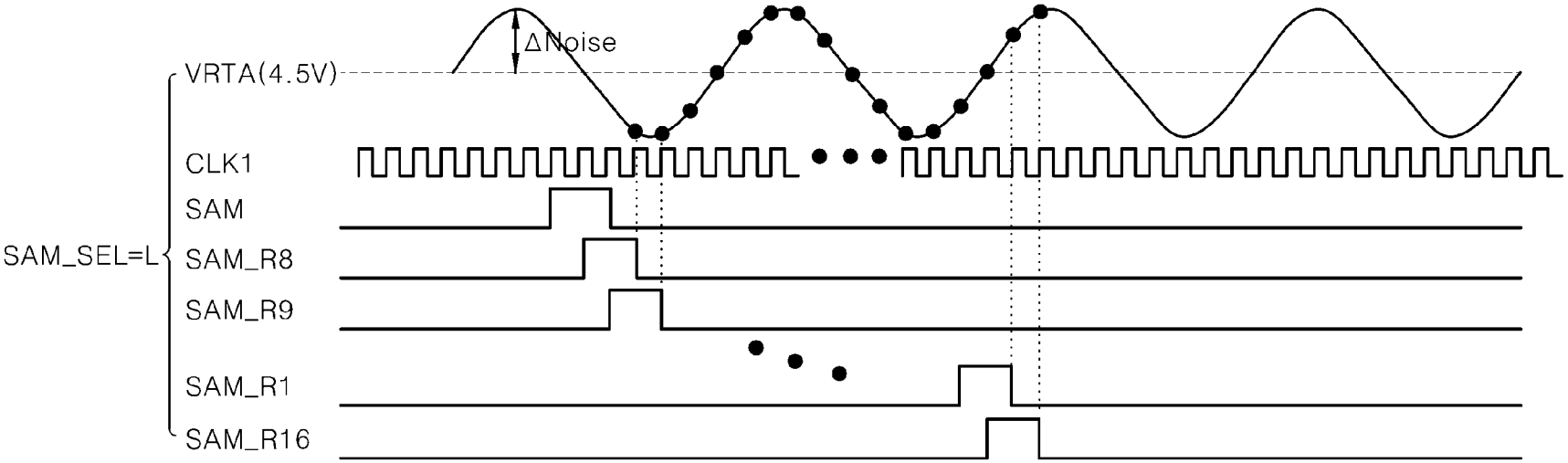
FIG. 14 is a timing diagram showing an example discrete sampling interval set to be narrow according to the present disclosure.

FIG. 14 is a timing diagram showing example discrete sampling intervals set to be narrow.

The MUX is disposed in the asynchronous discrete sampling enabler 810 as shown in FIG. 12 or the synchronous discrete sampling enabler 820 as shown in FIG. 13 to adjust a sampling interval. When a signal input as "SAM_SEL" to the MUX is set to have a low (L) value, a time interval at which the SAM signal is applied to each of SAM_R8/SAM_R9/SAM_R7/ . . . /SAMR1/SAM_R16 is set as a cycle of CLK1.

As a result, a process of sampling in each RTAOC dummy channel is shown in FIG. 14. SAM_R8 is sampled first, and then, SAM_R9 is sampled in a latter part of a time period for the SAM_R8 is sampled. Similarly, SAM_R1 disposed at an edge is sampled and then the SAM_R16 is sampled at a latter part of the time period for which the SAM_1 is sampled.

Figure 15:
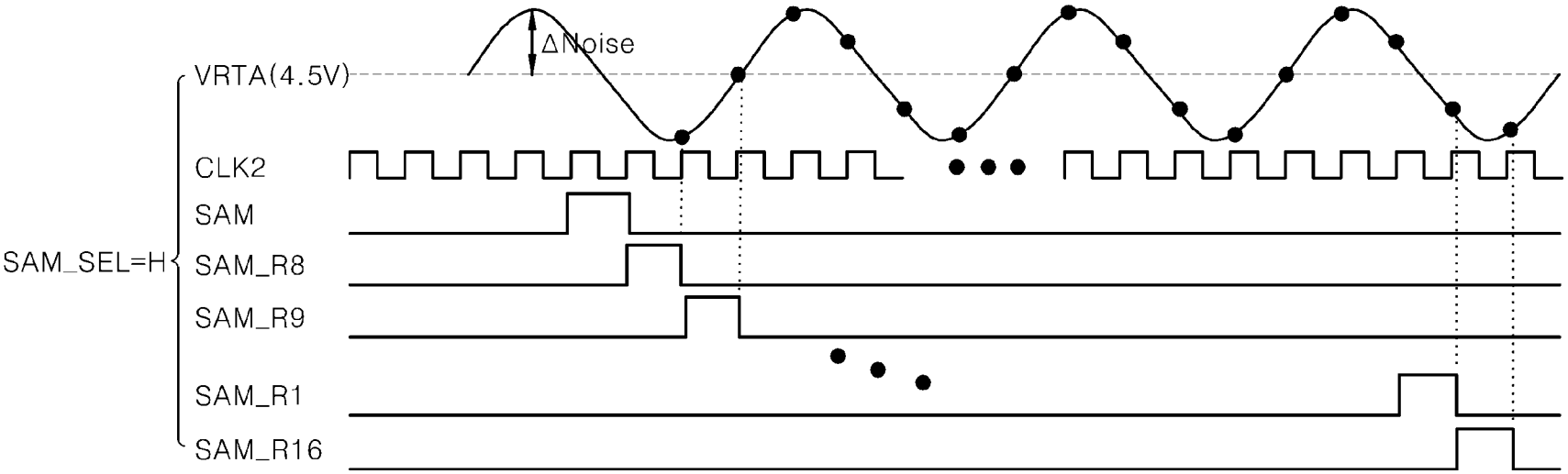
FIG. 15 is a timing diagram showing an example discrete sampling interval set to be wide according to the present disclosure.

FIG. 15 is a timing diagram showing an example discrete sampling interval set to be wide.

The MUX is disposed in the asynchronous discrete sampling enabler 810 as shown in FIG. 12 or the synchronous discrete sampling enabler 820 shown in FIG. 13 to adjust a sampling interval. When a signal input as "SAM_SEL" to MUX is set to have a high (H) value, a time interval at which the SAM signal is applied to each of SAM_R8/SAM_R9/SAM_R7/ . . . /SAMR1/SAM_R16 is set as a cycle of CLK2.

A process of sampling at each RTAOC dummy channel is shown in FIG. 15. SAM_R8 is sampled first, and then, SAM_R9 is sampled from a time point at which the sampling of the SAM_R8 is completed. Similarly, the SAM_R16 is sampled after sampling of the SAM_R1 disposed at an edge is completed.

As shown in FIG. 14 or 15, the sampling interval can be adjusted using MUX. The discrete sampling enabler can use two sampling intervals according to frequency characteristics of power noise.

Figure 17:
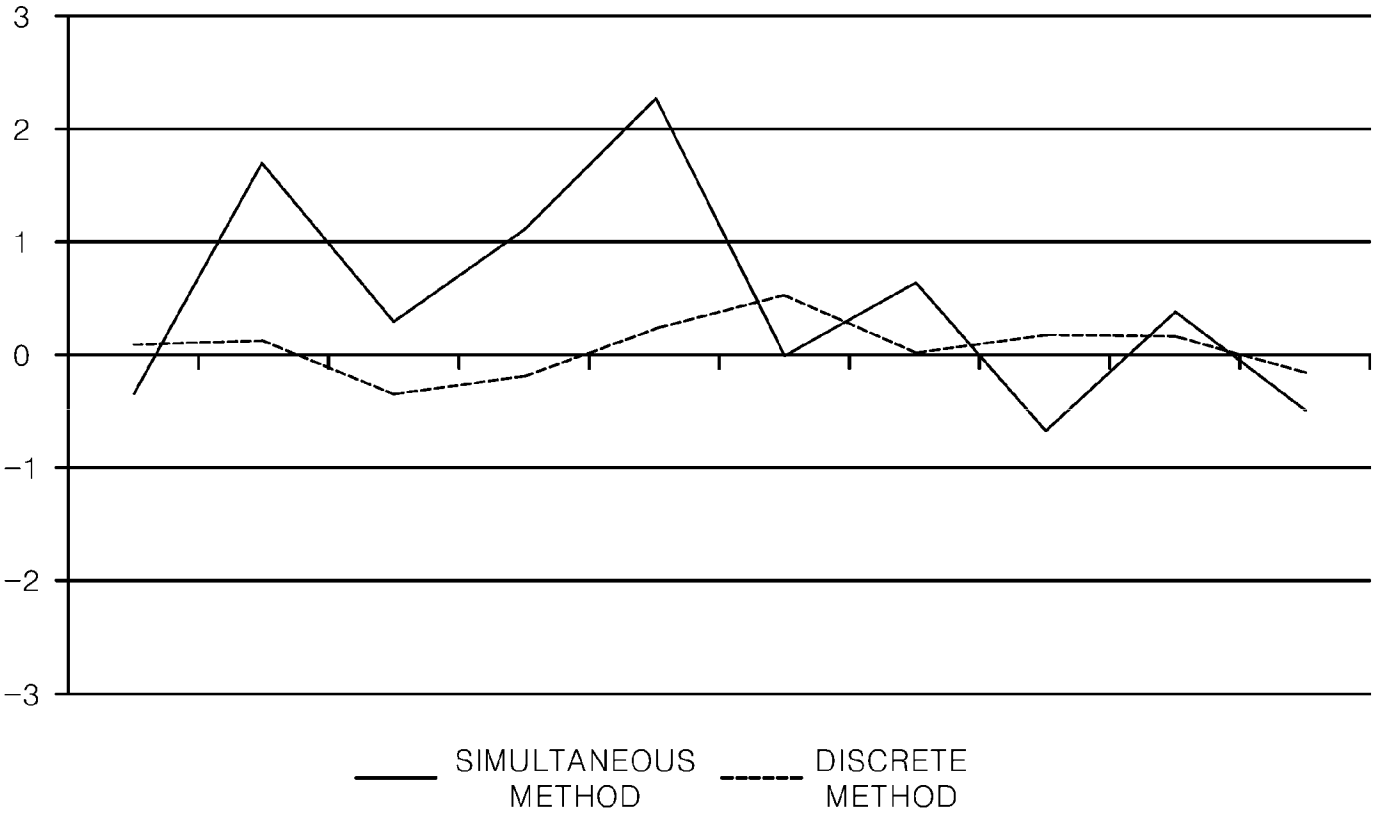

FIGS. 16 and 17 respectively show an example magnitude of noise during discrete sampling.

In one embodiment, a discrete sampling enabler can use a random function for 16 dummy channels. FIG. 16 shows a result sampled from a normal distribution with a center value 0 and a standard deviation of 1. In the case of a simultaneous sampling, an average value of noise fluctuates from −0.681 at minimum to 2.273 at maximum. A difference value between a maximum value of noise and a minimum value of noise is 2.954.

In some examples, in the case of discrete sampling, an average value of noise fluctuates from −0.355 at minimum to 0.525 at maximum. A difference value between a maximum value of noise and a minimum value of noise is 0.880.

FIG. 17 shows a magnitude of noise during each sampling. Discrete sampling has a less fluctuation value compared to simultaneous sampling. Therefore, when a discrete sampling enabler is added to an area where the RTAOC dummy channel is disposed to perform discrete sampling, a front horizontal line defect caused by the RTAOC due to power noise fluctuation can be prevented during OFFRS compensation.

Figure 18:
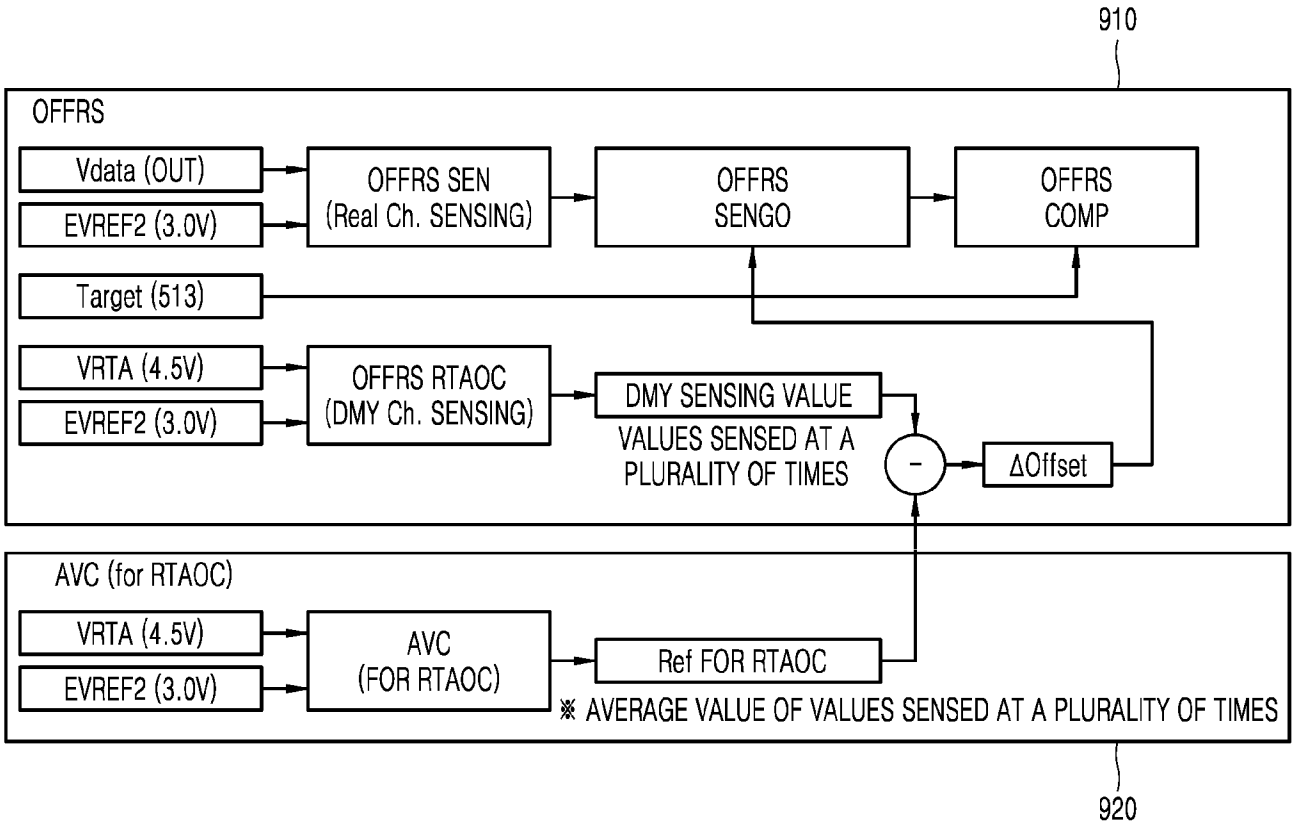
FIG. 18 is an exemplary diagram showing an example process of using discrete sampled values to perform OFFRS according to the present disclosure.

FIG. 18 shows an example process in which discrete sampled values are used for OFFRS. Operation of the controller 400 is classified in detail.

A thermal property sensing voltage VRTA and a reference voltage EVREF2 are applied in an off mode and thermal property sensing data which is a value sensed at the RTAOC dummy channel is used during the OFFRS to perform OFFRS sensing and compensation.

In more detail, as shown in RTAOC reference voltages 920 and 910, an offset value (Δoffset) is calculated based on a sensing value (a DMY sensing value) obtained by sensing multiple dummy channels through OFFRS RTAOC. In some examples, the OFFRS sensing (OFFRS SEN) is also performed on a line (e.g., a real channel) of a display panel.

The offset sensed by the dummy channel and calculated is combined with a value sensed at a line (e.g., an actual channel) of the display panel (OFFRS SENGO). The calculated offset is used as thermal property sensing data during the OFFRS compensation. The controller 400 performs the OFFRS compensation (OFFRS COMP).

The DMY sensing value is used to perform the discrete sampling. As a result, the discrete sampling is performed at different time points according to a number of dummy channels, and as values sensed by the channels have fluctuation values, noise may not be accumulated and can be cancelled.

Figure 19:
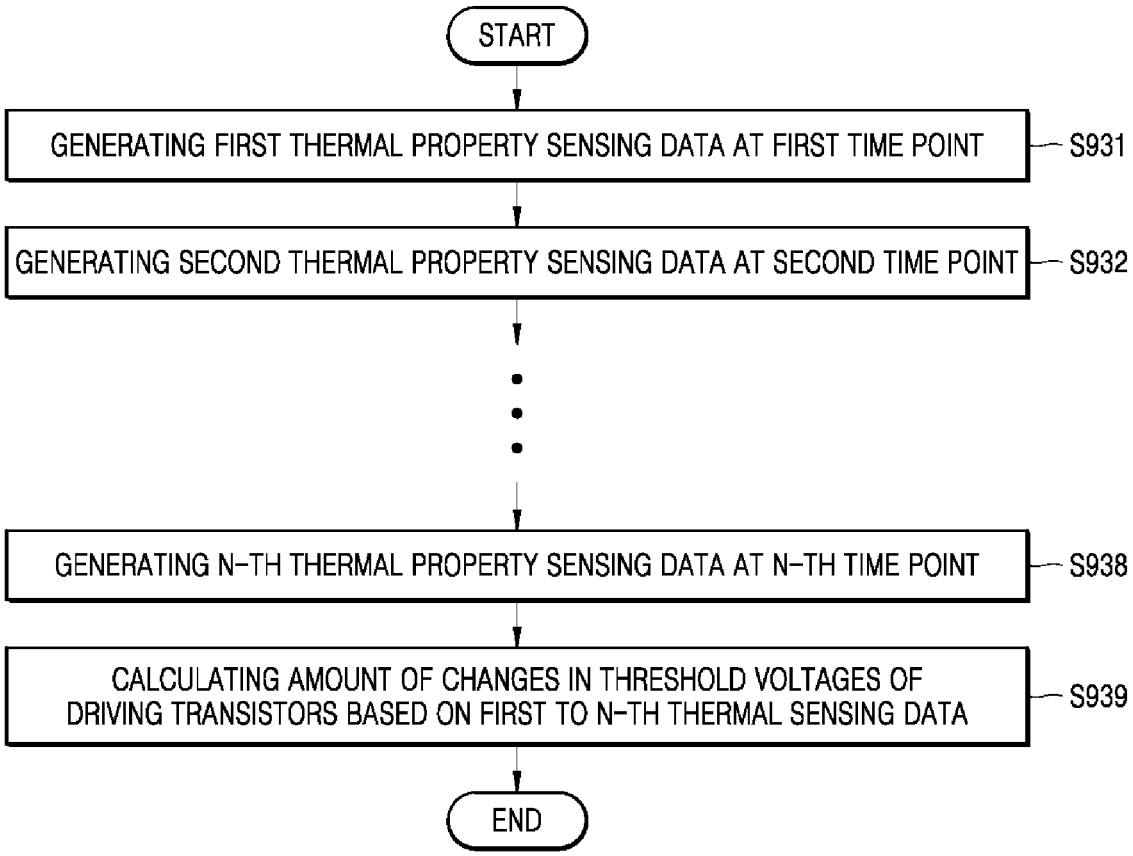
FIG. 19 is an exemplary diagram showing an example process of discretely sampling thermal property sensing data by an organic light emitting display device according to the present disclosure.

FIG. 19 shows an example process of discretely sampling thermal property sensing data by an organic light emitting display device. A time interval for discrete sampling is referred to a time interval between the sampling time points in FIGS. 11, 14, and 15.

During driving of the organic light emitting display device, a data driver IC 300 generates sensing data corresponding to a threshold voltage of a driving transistor and first thermal property sensing data on changes in characteristics due to a heat of an analogue-to-digital converting portion disposed in the data driver IC at a first time point (S931).

Similarly, the data driver IC 300 generates second thermal property sensing data at a second time point (S932), generates third thermal property sensing data at a third time point (S933), . . . , generates N-th thermal property sensing data at an N-th time point (S938).

Subsequently, the controller 400 calculates an amount of changes in threshold voltages of the driving transistor in each horizontal line unit based on the sensing data, the first thermal property sensing data, the second thermal property sensing data, . . . , the Nth thermal property sensing data received through the analogue-to-digital converting portion ADC (S939). A front horizontal line noise occurring due to a deviation in power noise can be prevented using the discrete sampling method shown in FIG. 19.

Hereinafter, a method of calculating the external compensation values by the organic light emitting display device in the off mode according to the present disclosure is described with reference to the drawings. Descriptions identical or similar to those described above among the following descriptions are omitted or briefly described.

When power is supplied to the organic light emitting display device and the input image data is supplied from the external system, the organic light emitting display device outputs an image through the organic light emitting display panel 100.

While the image is output, processes of performing internal compensation or external compensation by sensing the mobility of the driving transistors Tdr of the organic light emitting display panel in the sensing mode can be performed.

When a user using the organic light emitting display device turns off a power supply switch of the electronic device to turn off the electronic device including the organic light emitting display device, the external system of the electronic device generates a device off signal to supply the generated device off signal to the controller 400.

When the device off signal is received, the controller 400 generates the data control signal DCS, for example, a reference voltage supply sensing signal SPRE such that the data driver IC 300 senses the threshold voltages and transmits the generated data control signal DCS, for example, the reference voltage supply sensing signal SPRE to the data driver IC 300.

When the second switch 323 of the data driver IC 300 is turned on based on the reference voltage supply sensing signal SPRE, the reference voltages Vref received from the power supply 500 are supplied to pixel driving circuits PDCs of the pixels in a first horizontal line through the second switches 323 and the sensing lines SL.

A timing at which the reference voltage Vref is supplied to sense the threshold voltage and specific methods for sensing the threshold voltage can be variously changed.

When the timing for finally sensing the threshold voltages of the driving transistors disposed in the horizontal line arrives, the controller 400 transmits the sensing control signal SAM to the data driver IC 300.

The first switch 322 and the at least one third switch 324 of the at least one data driver IC 300 are each turned on based on the sensing control signal SAM.

For example, the sensing voltages generated by the pixels in the horizontal line are transmitted to the analogue-to-digital converting portion 325 through the first switches 322 and the thermal property sensing data VRTA is transmitted to the analogue-to-digital converting portion 325 through the third switch 324.

The analogue-to-digital converting portion 325 generates sensing data Sdata and at least two pieces of thermal property sensing data RTAdata sensed at the first horizontal line and transmits each of the sensing data S data and at least two pieces of thermal property sensing data RTAdata to the controller 400. In some cases where a large number of thermal property sensing data are provided, the large number of thermal property sensing data can be discretely sampled. For example, a plurality pieces of thermal property sensing data are sampled with time intervals.

When the sensing data S data and the thermal property sensing data (RTAdata) sensed at the first horizontal line are received, the controller 400 determines changes in characteristics due to a temperature of the analogue-to-digital converting portion 325 based on the thermal property sensing data. For example, the controller 400 determines a deviation value between the thermal property sensing data RTAdata and the thermal property sensing voltage VRTA.

The controller 400 can calculate external compensation values used for the pixels in the first horizontal line based on the deviation value and the sensing data Sdata or can calculate an amount of changes in threshold voltages of the pixels in the first horizontal line. An amount of changes in the threshold voltages are used to calculate the external compensation values.

The controller 400 stores the external compensation value or an amount of changes in the storage portion 450.

The controller 400 repeatedly performs the processes on the second horizontal line to the g-th horizontal line and calculates and stores the external compensation values or an amount of changes in each horizontal line unit.

When an amount of changes in external compensation values or threshold voltages for the g-th horizontal line are calculated, the controller 400 can transmit a sensing completion signal indicating that operation of sensing the threshold voltage is completed to the external system. The power supplied to the data driver IC is cut off based on the sensing completion signal, and thus, the electronic device including the organic light emitting display device is turned off.

When the electronic device is turned off and then turned on again, the controller 400 can compensate for the input image data received from the external system based on the external compensation values or can compensate for it based on the external compensation values generated using an amount of changes in threshold voltages.

When the image data generated during the compensation is transmitted to the data driver IC 300, the data driver IC 300 supplies the data voltages corresponding to the image data to the organic light emitting display panel 100 through the data lines such that the image can be output from the organic light emitting display panel 100.

When the external compensation values are calculated in the horizontal line unit, any one of the thermal property sensing data among the thermal property sensing data RTA-data sequentially generated in each horizontal line unit can exceed a preset threshold. The fact that the thermal property sensing data exceeds the threshold value refers that the sensing data S data is not normally generated by the analogue-to-digital converting portion 325. In this case, the controller 400 can perform various measures.

For example, the controller 400 may not calculate the external compensation values for the driving transistors in the event horizontal line corresponding to the thermal property sensing data exceeding the threshold value and can calculate the external compensation values by performing the sensing on the remaining horizontal lines.

The controller 400 can control the data driver IC 300 to generate thermal property sensing data for the event horizontal line based on an elapse of a predetermined time period after receiving the thermal property sensing data for the remaining horizontal lines.

The calculator 410 calculates an amount of changes in threshold voltages of the driving transistors in the event horizontal line based on the sensing data received from the data driver IC to generate external compensation values corresponding to the event horizontal line. When the external compensation values for the event horizontal line are generated, a sensing completion signal can be transmitted to the external system.

However, if the thermal property sensing data generated again at the event horizontal line exceeds the threshold value, the controller can transmit each of an error signal and the sensing completion signal to the external system as described in another example below.

As another example, the controller 400 may not sense the external compensation values for the driving transistors in the event horizontal line corresponding to the thermal property sensing data exceeding the threshold value and horizontal lines after the event horizontal line and can transmit a sensing completion signal to the external system. In this case, the error signal indicating that a problem has occurred in the analogue-to-digital converting portion 325 can be transmitted to the external system.

When the electronic device is turned off and then turned on, the external system can transmit input image data forming a message related to the problem of the analogue-to-digital converting portion 325 to the controller 400. In this case, the controller 400 can control each of the data driver IC 300 and the gate driver 200 to output the message through the organic light emitting display panel 100. The user determining the above can solve the problem of the analogue-to-digital converting portion 325 using an after service (AS).

The external system can transmit input image data related to a general image to the controller 400 based on an elapse of a predetermined time period after outputting the message. In this case, the controller 400 can control each of the data driver IC 300 and the gate driver 200 to output the image, for example, an image desired by the users, through the organic light emitting display panel 100.

As another example, the controller 400 may not generate external compensation values for the driving transistors in the event horizontal line corresponding to the thermal property sensing data exceeding the threshold value and can generate the external compensation values by performing the sensing on the remaining horizontal lines to transmit the sensing completion signal to the external system.

Subsequently, when the electronic device is turned off and then turned on, the external compensation may not be performed for the driving transistors in the event horizontal line or the external compensation values used for the horizontal line adjacent to the event horizontal line can be used for pixels in the event horizontal line.

Various methods can be further used as well as the above methods.

Those skilled in the art to which the present disclosure pertains will appreciate that the present disclosure can be implemented in other specific forms without changing its technical spirit or essential characteristics. Therefore, it should be understood that the embodiments described above are illustrative in all respects and not restrictive. The scope of the present disclosure is indicated by the following claims rather than the above detailed description, and it should be interpreted that all changes or modifications derived from the meaning and scope of the claims and equivalent concepts are included in the scope of the present disclosure.

What is claimed is:

1. An organic light emitting display device, comprising:

an organic light emitting display panel comprising a plurality of pixels with an organic light emitting diode (OLED) and a pixel driving circuit to drive the OLED, and a plurality of sensing lines which are connected to the pixels;

a data driver comprising at least one data driver integrated circuit (IC) connected to the sensing lines and configured to supply data voltages to the pixel driving circuits through a plurality of data lines disposed in the organic light emitting display panel; and a controller configured to control the at least one data driver IC to generate sensing data on a threshold voltage of a driving transistor and at least two pieces of thermal property sensing data on changes in characteristics due to a heat of an analogue-to-digital converting portion of the at least one data driver IC, with time intervals, and calculate an amount of changes in threshold voltages of the driving transistors in each horizontal line unit based on the sensing data and the at least two pieces of thermal property sensing data received through the analogue-to-digital converting portion.

2. The organic light emitting display device of claim 1, wherein the at least one data driver IC comprises a discrete sampling enabler configured to discretely sample the thermal property sensing data.

3. The organic light emitting display device of claim 2, wherein, in the discrete sampling enabler, some or all of N dummy lines to sense the thermal property sensing data are connected to a third terminal of each multiplexer (MUX) where N is a positive number, a first resistor is provided at a first terminal of each MUX, and a second resistor is provided at a second terminal of each MUX, wherein the third terminal of the MUX is connected to at least one of the first terminal or the second terminal based on a selection signal applied to the MUX, and wherein the at least one data driver IC is configured to sense thermal property sensing data in the N dummy lines at two or more different time points.

4. The organic light emitting display device of claim 3, wherein the plurality of first resistors are connected to one another electrically in series, the plurality of second resistors are connected to one another electrically in series, and one end of each of the first resistor and the second resistor connected in series is connected to a sampling signal line.

5. The organic light emitting display device of claim 3, wherein, in the discrete sampling enabler, some or all of the N dummy lines to sense the thermal property sensing data are connected to a third terminal of each flip flop, and a sampling signal line is connected at a first terminal of each flipflop, wherein a second terminal of the flip flop is connected to the third terminal of the MUX, wherein a first synchronization signal is applied to the first terminal of the MUX and a second synchronization signal is applied to the second terminal of the MUX, wherein the third terminal of the MUX is connected to at least one of the first terminal or the second terminal based on the selection signal applied to the MUX, and wherein the at least one data driver IC is configured to generate the thermal property sensing data in the N dummy lines based on at least one of the first synchronization signal or the second synchronization signal at two or more different time points.

6. The organic light emitting display device of claim 1, wherein the at least one data driver IC comprises:

a data power supply configured to supply the data voltages to the data lines; and a sensor configured to, in response to receiving a sensing control signal from the controller, convert sensing voltages received from the sensing lines into the sensing data which is a digital value, generate the thermal property sensing data, and transmit the sensing data and the thermal property sensing data to the controller, in each horizontal line unit.

7. The organic light emitting display device of claim 6, wherein the sensor comprises a plurality of sensing processors configured to supply the reference voltage to at least one sensing line, convert the sensing voltage received from the sensing line into the sensing data, and transmit the sensing data to the controller.

8. The organic light emitting display device of claim 7, wherein each of the sensing processors comprises:

a first switch configured to connect to at least one of the sensing lines and to turn on and turn off based on the sensing control signal;

a second switch configured to connect between the sensing line to which the first switch is connected and a power supply to supply a reference voltage and to turn on and turn off based on a reference voltage supply control signal; and an analogue-to-digital converter configured to connect between the controller and the first switch, convert the sensing voltage received through the first switch into the sensing data, and transmit the sensing data to the controller.

9. The organic light emitting display device of claim 8, wherein the analogue-to-digital converting portion comprises the analogue-to-digital converter of each of the sensing processors and at least one analogue-to-digital converter for thermal property to generate the thermal property sensing data.

10. The organic light emitting display device of claim 9, wherein the analogue-to-digital converter for thermal property is configured to connect to a third switch to turn on and turn off based on the sensing control signal, and wherein the analogue-to-digital converter for thermal property is configured to convert a thermal property sensing voltage received from the third switch into the thermal property sensing data and transmit the thermal property sensing data to the controller.

11. The organic light emitting display device of claim 10, wherein the sensor comprises the third switch.

12. The organic light emitting display device of claim 1, wherein the controller is configured to not calculate the amount of changes in threshold voltages of the driving transistors in an event horizontal line corresponding to the thermal property sensing data exceeding the threshold value, if at least one of the thermal property sensing data generated sequentially in each horizontal line unit exceeds a predetermined threshold value, and wherein the controller is configured to, based on an elapse of a predetermined time period after receiving the thermal property sensing data for remaining horizontal lines, control the at least one data driver IC to generate the thermal property sensing data for the event horizontal line, and calculate the amount of changes in threshold voltages of the driving transistors in the event horizontal line based on sensing data received from the at least one data driver IC.

13. The organic light emitting display device of claim 1, wherein the controller comprises:

a data aligner configured to rearrange input image data received from an external system based on a timing synchronization signal received from the external system and supply the realigned image data to the at least one data driver IC;

a control signal generator configured to generate a data control signal to control the at least one data driver IC based on the timing synchronization signal;

a calculator configured to calculate an external compensation value for compensating for changes in characteristics of the driving transistor of each of the pixels based on the sensing data and the thermal property sensing data received from the at least one data driver IC;

a storage portion configured to store the external compensation value; and an output portion configured to output each of the image data and the data control signal generated by the data aligner to the at least one data driver IC, wherein the data aligner is configured to convert the input image data into the image data based on the external compensation values.

14. A method for driving an organic light emitting display device, the organic light emitting display device comprising an organic light emitting display panel with a plurality of pixels with an organic light emitting diode (OLED) and a pixel driving circuit to drive the OLED, the pixels being connected to sensing lines, a data driver with at least one data driver IC configured to supply data voltages to the pixel driving circuits through data lines disposed in the organic light emitting display panel and to connect to the sensing lines, and a controller configured to control the at least one data driver IC, the method comprising:

generating, by the at least one data driver IC, sensing data on threshold voltages of driving transistors at a first time point and first thermal property sensing data on changes in characteristics due to a heat of an analogue-to-digital converting portion of the at least one data driver IC;

generating, by the at least one data driver IC, sensing data on threshold voltages of driving transistors at a second time point and second thermal property sensing data on changes in characteristics due to a the heat of the analogue-to-digital converting portion provided in the at least one data driver IC; and calculating an amount of changes in threshold voltages of the driving transistors in each horizontal line unit based on the sensing data, the first thermal property sensing data, and the second thermal property sensing data received through the analogue-to-digital converting portion.

15. The method for driving the organic light emitting display device of claim 14, further comprising discretely sampling, by a discrete sampling enabler of the at least one data driver IC, the first thermal property sensing data and the second thermal property sensing data with different first time point and second time point.

16. The method for driving the organic light emitting display device of claim 15, wherein, in the discrete sampling enabler, some or all of N dummy lines to sense the thermal property sensing data are connected to a third terminal of each multiplexer (MUX) where N is a positive number, a first resistor is provided at a first terminal of each MUX, and a second resister is provided at a second terminal of each MUX, the method comprising:

connecting, by the discrete sampling enabler, the third terminal of the MUX to at least one of the first terminal or the second terminal based on a selection signal applied to the MUX; and sensing the thermal property sensing data in the N dummy lines at two or more different time points.

17. The method for driving the organic light emitting display device of claim 16, wherein, in the discrete sampling enabler, some or all of the N dummy lines to sense the thermal property sensing data are connected to a third terminal of each flip flop, and a sampling signal line is connected at a first terminal of each flipflop, wherein a second terminal of the flip flop is connected to the third terminal of the MUX, wherein a first synchronization signal is applied to the first terminal of the MUX and a second synchronization signal is applied to the second terminal of the MUX, the method comprising:

connecting, by the discrete sampling enabler, the third terminal of the MUX to at least one of the first terminal or the second terminal based on a selection signal applied to the MUX; and sensing, by the at least one data driver IC, the thermal property sensing data at the N dummy lines based on at least one of the first synchronization signal or the second synchronization signal at two or more different time points.

* * * * *